US006827509B2

(12) United States Patent
Suden et al.

(10) Patent No.: US 6,827,509 B2
(45) Date of Patent: Dec. 7, 2004

(54) CD TRANSPORTER WITH RE-TRANSFER PRINTER

(75) Inventors: David Suden, Minneapolis, MN (US); Jay Carter, Apple Valley, MN (US); William Vangen, Minnetonka, MN (US); Hiroshi Takahashi, Tamayama-mura (JP); Takashi Onozato, Morioka (JP); Tadami Kikuchi, Takizawa-mura (JP); Tadashi Nakamura, Morioka (JP); Toshihiko Hatakeyama, Takizawa-mura (JP)

(73) Assignee: Rimage Corporation, Minneapolis, MN (US)

( * ) Notice: Subject to any disclaimer, the term of this patent is extended or adjusted under 35 U.S.C. 154(b) by 126 days.

(21) Appl. No.: 09/854,897

(22) Filed: May 14, 2001

(65) Prior Publication Data

US 2002/0168205 A1 Nov. 14, 2002

(51) Int. Cl.[7] ..... B41J 2/315

(52) U.S. Cl. ..... 400/120.01; 400/120.03; 101/35; 101/37; 347/213; 347/217

(58) Field of Search ..... 101/35, 38.1, 41, 101/43, 44, 37; 400/120.01, 120.03, 120.04; 347/213, 217

(56) References Cited

U.S. PATENT DOCUMENTS 4,396,308 A * 8/1983 Applegate et al. ..... 400/696
5,518,325 A * 5/1996 Kahle ..... 400/70
5,542,768 A * 8/1996 Rother et al. ..... 400/120.16
5,797,688 A 8/1998 Wen
5,798,161 A * 8/1998 Kita et al. ..... 428/64.1
5,894,069 A 4/1999 Wen et al.
5,907,345 A * 5/1999 Bothner et al. ..... 347/156
5,927,208 A 7/1999 Hagstrom et al.
5,967,676 A 10/1999 Cutler et al.
5,982,405 A * 11/1999 Sasaki et al. ..... 347/176
6,041,703 A 3/2000 Salisbury et al.
6,082,256 A 7/2000 Hellmeier et al.
6,121,987 A * 9/2000 Sasaki et al. ..... 347/176
6,148,721 A 11/2000 Hellmeier et al.
6,148,722 A 11/2000 Hagstrom
6,222,800 B1 * 4/2001 Miller et al. ..... 369/30.19
6,272,983 B1 8/2001 Plant Chupurdy
6,284,708 B1 9/2001 Oshima et al.
6,302,601 B1 10/2001 Hagstrom et al.
6,312,174 B1 11/2001 Drynkin et al.
6,400,659 B1 * 6/2002 Kitaoka ..... 369/34.01
6,447,181 B1 * 9/2002 Hagstrom et al. ..... 400/120.01
6,486,904 B1 * 11/2002 Onozato et al. ..... 347/213
6,532,198 B1 * 3/2003 Miller ..... 369/30.43

OTHER PUBLICATIONS

Patent Abstracts of Japan: Publication No. 08067017, Publication Date Mar. 12, 1996.

* cited by examiner

*Primary Examiner*—Andrew H. Hirshfeld
*Assistant Examiner*—Dave A. Ghatt
(74) *Attorney, Agent, or Firm*—Leffert Jay & Polglaze, P.A.

(57) ABSTRACT

A compact disc transporter has been described that includes a two-step printer. The printer uses an intermediate transfer sheet to receive a print image that is subsequently transferred to a compact disc. The transporter allows parallel processing of image data and content data. A significant time reduction can be achieved by preprinting the image to a transfer sheet prior to transferring the image to a CD.

6 Claims, 16 Drawing Sheets

CD TRANSPORTER WITH RE-TRANSFER PRINTER

FIELD OF THE INVENTION

The present invention relates generally to storage medium processing and in particular the present invention relates to a medium handler and organizer.

BACKGROUND OF THE INVENTION

Compact discs are used as a storage medium for digital information. The data is stored on the compact disc by varying the optical characteristics of the disc. This digital information can be any type of data, such as, but not limed to, audio, image, photo and/or video information. In other words, the digital data stored on a compact disc can vary from disc to disc. Different types of compact discs can be provided, a traditional type of compact disc is manufactured using a plastic mold operation. Each compact disc manufactured using the same mold contains the same digital information. As such, large production runs of compact discs, which contain the same information, such as a musical composition, are manufactured in an economical manner by using a molding process.

A different type of compact disc, which is commercially available, is a recordable compact disc. This type of disc is manufactured such that it does not contain data thereon, but can be programmed after it is manufactured. The optical characteristics, therefore, of the compact disc are modified after it is fabricated depending upon the data that is stored on the disc. In the context of the present invention, it is to be understood that reference to a compact disc (CD) includes and encompasses Compact Disc Recordable "CD-R", Compact Disc Readable "CD-RW", CD-ROM, CD-PROM, Digital Versatile Disc "DVD", DVD-R, DVD-RAM, DVD-RW, or any disc for data storage.

To identify the data stored on a compact disc, a label is often printed on one side of the compact disc. For large manufacturing runs of a common compact disc, a silkscreen process is often used to apply the label to the compact disc. For small production runs of compact discs, such as those using recordable compact discs a silkscreen operation may not be economical. A custom printing operation, therfore, can be employed to print a custom label on each compact disc. See for example U.S. Pat. No. 5,734,629 entitled "CD Transporter" issued Mar. 31, 1998 for a description of a compact disc transporter that can be used to move a compact disc between a data recorder and a printer.

One suitable thermal transfer printer is the Perfect Image CD Printer manufactured by Rimage Corporation, of Minneapolis, Minnesota. An important advantage that thermal transfer printers enjoy over inkjet printers to labeling CD's is that they do not require specially coated CD-ROMs to accept the ink from the printing process. Though most media manufacturers offer printable discs, they are more expensive than traditional media and may not be as readily available. Further details regarding such thermal transfer printers which may be used in the system according to the present invention may be found in an article in CD-ROM Professional, September 1996, at pages 86–90. U.S. Pat. No. 5,542,768 "Apparatus for printing on plastic disk" issued Aug. 6, 1996 describes a printer for printing indicia to a compact disc. Also see, U.S. Pat. No. 5,797,688 issued Aug. 25, 1998 "Thermal dye transfer printing of compact disc labels including a circular recessed carrier" and U.S. Pat. No. 5,894,069 "Apr. 13, 1999 Transferring colorant from a donor element to a compact disc". U.S. Pat. No. 6,148,722 issued Nov. 21, 2000 "Compact disc and recordable compact disc thermal transfer printer" described another type of printer for use with compact discs.

For the reasons stated above, and for other reasons stated below which will become apparent to those skilled in the art upon reading and understanding the present specification, there is a need in the art for the compact disc handling apparatus which more efficiently process compact discs and improves image quality of printed indicia.

SUMMARY OF THE INVENTION

The above-mentioned problems with compact disc transporters and other problems are addressed by the present invention and will be understood by reading and studying the following specification.

In one embodiment, a compact disc processing system comprises a data recorder to record content to a compact disc, a transporter to transport the compact disc, and a re-transfer printer to print an image to an internal intermediate transfer sheet and transfer the image from the transfer sheet to the compact disc.

In another embodiment, a content on demand processing system comprises a processor, a data recorder to record content to a compact disc, wherein the content is provided by the processor, a transporter to transport the compact disc, and a re-transfer printer to print an image to an internal intermediate transfer sheet and transfer the image from the transfer sheet to the compact disc, wherein image data is provided by the processor.

A method of processing a compact disc (CD) comprises transferring each ink of a multicolor ink film onto an intermediate transfer sheet by a line thermal head to form a primary transfer image, printing a positioning mark which serves as a position reference on the intermediate transfer sheet, forming a primary transfer image of plural colors on the intermediate transfer sheet in a superimposed relation with the transferred positioning mark as a reference, and retransferring the primary transfer image onto a CD, thereby forming a desired image on the CD.

Another method of processing a compact disc (CD) comprises loading content data that is to be recorded to the CD, loading image data to produce an image on the CD, transporting the CD to a recorder, recording the content data on the CD, transporting the CD to a printer, and prior to completing the transport of the CD to the printer, printing the image to an intermediate transfer sheet of the printer.

Yet another method of processing a compact disc (CD) comprises loading content data that is to be recorded to multiple CD's, loading multiple image data to produce images on the CD's, recording the content data on the CD's, and sequentially printing the images to an intermediate transfer sheet of the printer.

DETAILED DESCRIPTION OF THE DRAWINGS

In the following detailed description of the preferred embodiments, reference is made to the accompanying drawings, which form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims.

Figure 2:
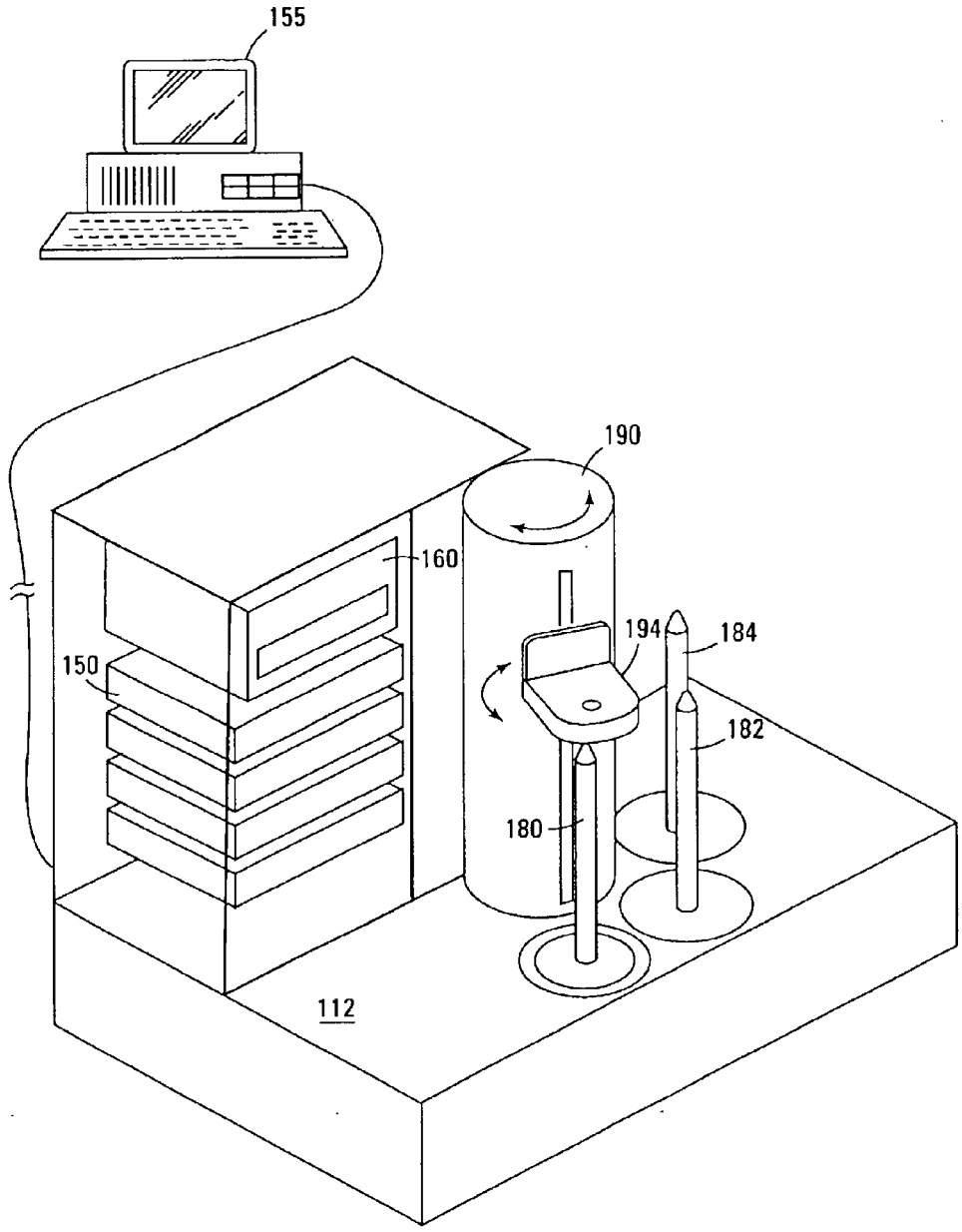
FIG. 2 is a perspective view of another transporter of an embodiment of the present invention.
Figure 3:
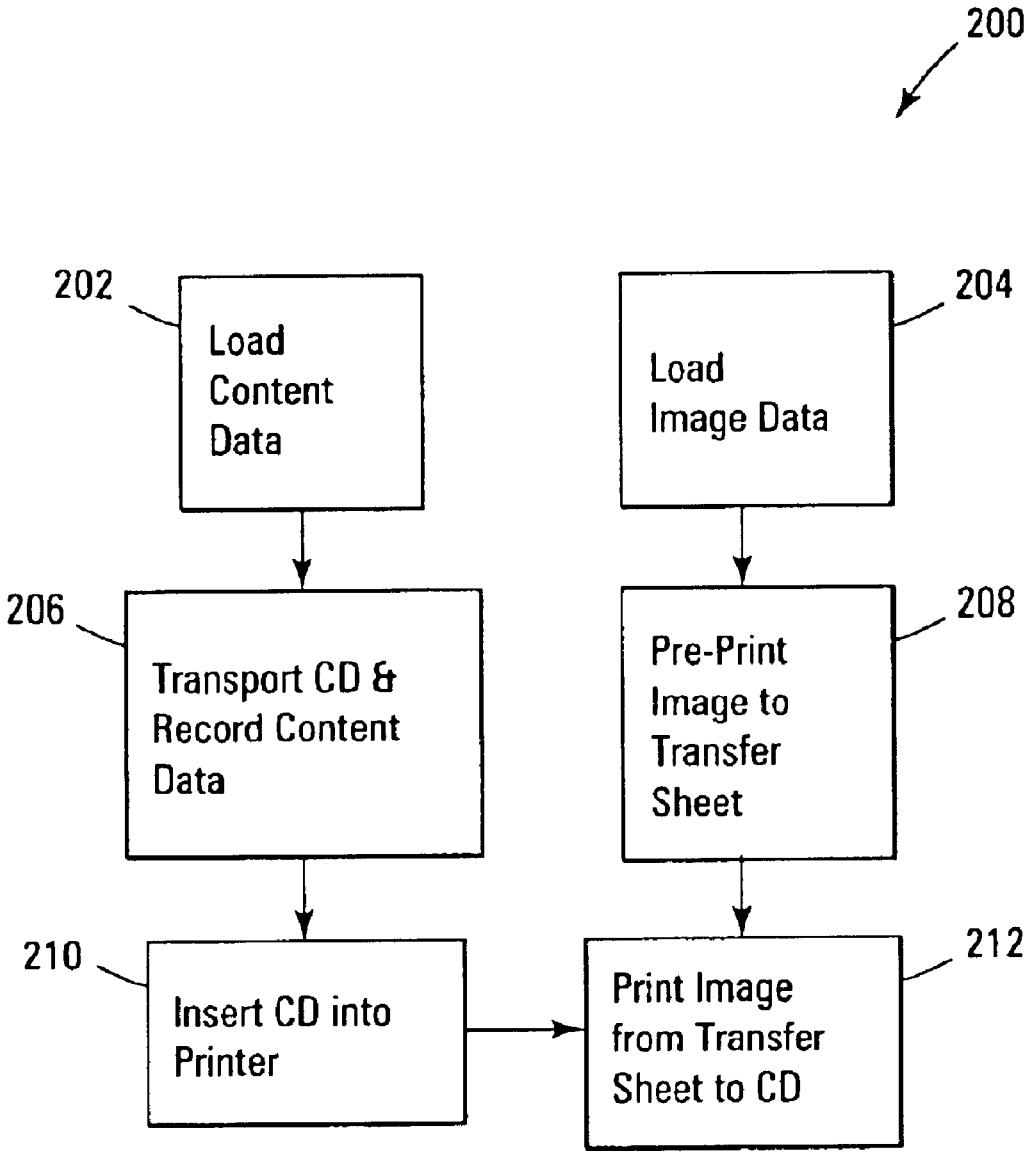
FIG. 3 is a flow chart of a method of the present invention.

In the following description, a compact disc transporter is described for transporting a compact disc between multiple process stations. These stations may include a printer, a recorder, a reader or verifier, and a compact disc supply station. Methods are described for pre-positioning a compact disc prior to printing so that preprinted images can be positioned relative to subsequent printed images. It will be appreciated by those skilled in the art, that the transporter illustrated in FIGS. 1-3 is but one possible embodiment.

Figure 1:
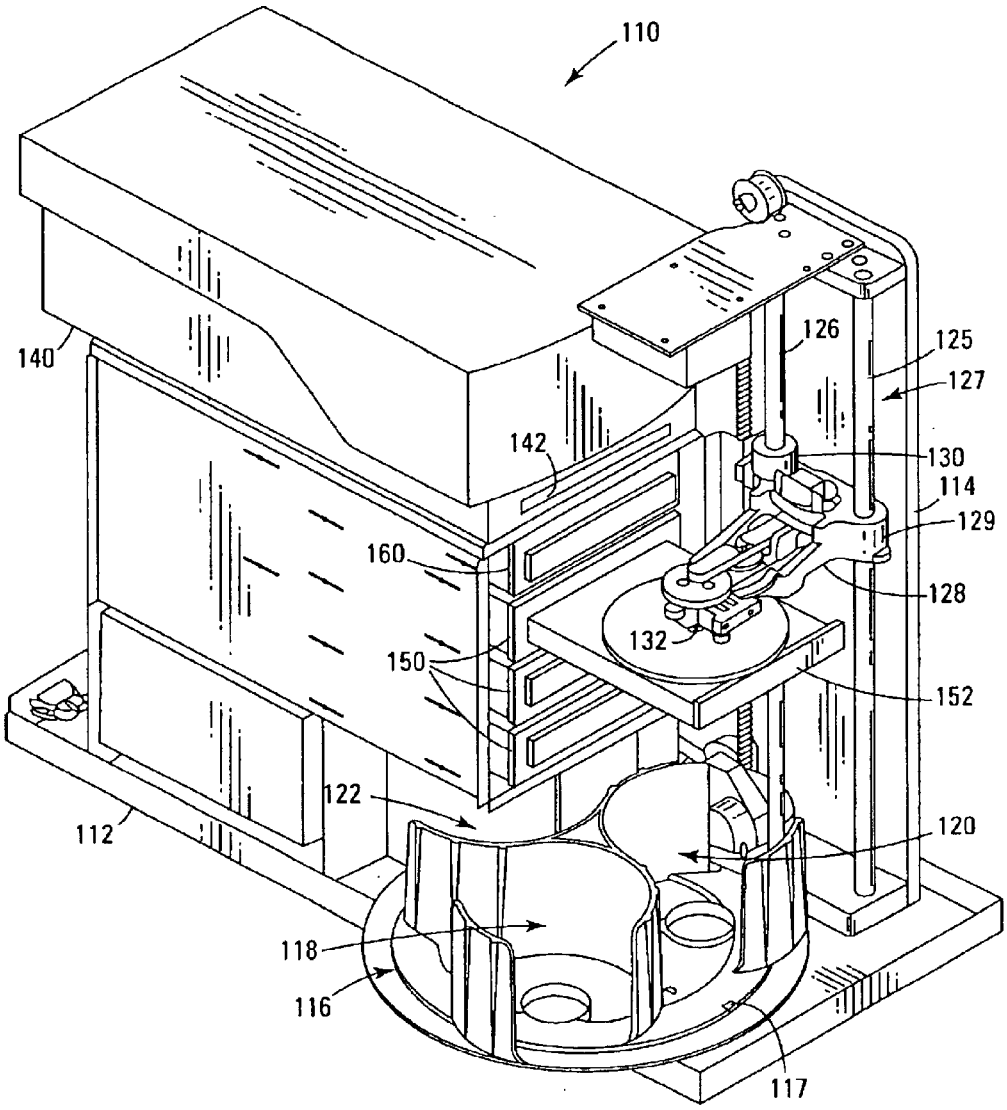
FIG. 1 is a perspective view of a transporter of an embodiment of the present invention.

Referring to FIG. 1, an embodiment of transporter 110 has a base 112 and a vertical support frame 114. A carousel turntable 16 is rotatably mounted to base 112, and three CD bins 118, 120 and 122 are affixed to turntable 116. One of these bins functions as an input or supply bin, the second bin functions as an output bin, and the third bin functions as a reject collection bin. The carousel turntable 116 is rotatably controllable by a stepper or servo motor which is connected to carousel turntable beneath the base 112. The motor is preferably positionable to three stop positions by a computer processor, which also controls the other functions, in conjunction with position sensors which are selectively placed to monitor positions of the various moving components. For example, carousel 116 has an index mark 117 that may be sensed by an optoelectric sensor (not shown) to detect the "home" position of carousel 116.

A carriage assembly 124 is affixed to base 112 by a pair of guide shafts 125, 126. Carriage assembly 124 has a carriage 128, which is slidably movable over guide shafts 125, 126 via a pair of yokes 129, 130 that have bearing surfaces to facilitate slidable movement. Carriage 128 is vertically movable from a lower position proximate turntable 116 to an upper position aligned with the topmost component of transporter 110.

Carriage 128 has a gripper 132 affixed to its underside. Gripper 132 can have three expandable and contractible fingers for insertion into the center hole of a CD and expanding to grasp the CD by its center hole for movement. Other gripper configurations can be used. For example, a vacuum based gripper can be used to grasp a compact disk. Further, a flexible spring gripper can be incorporated, see U.S. Pat. No. 6,220,640 issued Apr. 24, 2001 "Device and method of gripping a compact disc".

The gripper 32 may be rotated by a gripper motor. The motor is preferably a stepper motor which is controllable by the computer processor to rotatably align a CD which is gripped by gripper 132. A sensor is positioned to have a field of view of a top surface of a compact disc which is engaged to the gripper 132. This sensor can be any known type of detection device and can be mounted in any positioned desired to detect a rotational position of the disc. One type of sensor which can be used is an optical sensor detecting light reflected off of the CD surface. Another type of sensor is a camera, which obtains an image of the CD.

A printer 140 is positioned proximate the upper end of support frame 114. printer 140 has an opening 142 positioned adjacent the path of travel of carriage 128. A printer drawer may be opened outwardly from opening 142, and may be pulled inwardly into printer 140. The drawer has a circular seat sized to receive a CD, which may be deposited therein by selective movement of carriage 128 and gripper 132.

It may be desired that the printer only print indicia on selected areas of the CD surface. As such, the gripped CD is rotated and aligned using the sensor for proper insertion into the printer 140. See U.S. Pat. No. 6,041,703 issued Mar. 28, 2000 "Compact disc printing system and method" describing one method of orienting a CD for printing. For purposes of conciseness, indicia is used herein to describe any material provided or printed on a surface of a compact disc and is not limited to textual information, identification, graphics or identifying marks.

One or more recorders 150 may be stacked in vertical arrangement adjacent to vertical frame 114, and each recorder 150 has a recorder drawer 152 which may be extended to receive a CD from gripper 132 on carriage 128. Each recorder 150 is equipped to record data on the CD in any format or arrangement dictated by the computer processor 115. FIG. 1 shows a recorder drawer 152 in an open position with the carriage 128 positioned to load or unload a CD into drawer 152.

A verifier 160 may also be vertically stacked adjacent to frame 114. Verifier 160 has a drawer which operates similar to that of recorder 150 to receive a CD from carriage 128. Verifier 160 functions to read the data stored on a CD, usually after a recorder 150 has completed its recording operation, and to verify the correctness of this data by comparison to the data pre-stored in the computer processor 155.

The above-described transporter is one possible embodiment of a printing device. It will be appreciated that the variations are contemplated. For example, the transporter can include bins, which move in a linear motion, not rotational. Further, the recorders and reader can be included as optional features. Thus, the transporter would primarily operate as a printing device.

Referring to FIG. 2, an alternate embodiment of a transporter according to one embodiment of the present invention is described. The transporter system is substantially the same as the above-described transporter. This embodiment, however, uses spindles 180, 182 and 184 to hold CD's during processing. The transporter carriage 190 can rotate about a vertical axis to reach each spindle. A gripper 194 is used to slide over the spindles and grasp CD's. Gripper 194 can rotate about a horizontal axis to grasp two CD's, see U.S. Pat. Ser. No. 09/501,434, filed Feb. 10, 2000 "MEDIUM HANDLER AND ORGANIZER" incorporated herein by reference.

The transporter embodiments described above include a re-transfer printer 1. The printer uses an intermediate ribbon, or sheet, that receives image, or indicia, that is to be printed on the processed compact discs. The printer improves image quality and processing time, as explained below. The improved printer allows reproduction of original compact disc art. Thus, an impediment to "content on demand" systems can be eliminated with the present invention. That is, a business method of recording content (music, video, software) on demand at remote locations has not found broad acceptance because accurate, fast reproduction of original disc artwork has not been available. The present invention solves this problem.

The present printer includes multiple color sources, or ink ribbons, that are used to create print images from image data. Ink from one or more ribbons is transferred during a first process step to a transfer sheet, as explained in detail below. An index mark printed on the transfer sheet is used by the printer to align subsequent colors. After the composite image is pre-printed to the transfer sheet, the image is thermally transferred to a compact disc. The quality of the resulting image is substantially the same as silkscreen processes currently used in large volume disc productions.

Referring to FIG. 3, a flow chart of a method 200 of operating a CD transporter is described. Content data that is to be recorded to a CD is loaded, 202. Similarly, image data to produce an image on the CD is loaded, 204. The CD is transported to a recorder and the content data is recorded to the CD, 206. At the same time, the image is printed to the transfer sheet, 208. By parallel processing the image and the CD transporting, the overall time is reduced. The CD is inserted into the printer at 210 and then the image is transferred from the transfer sheet to the CD, 212.

Figure 4:
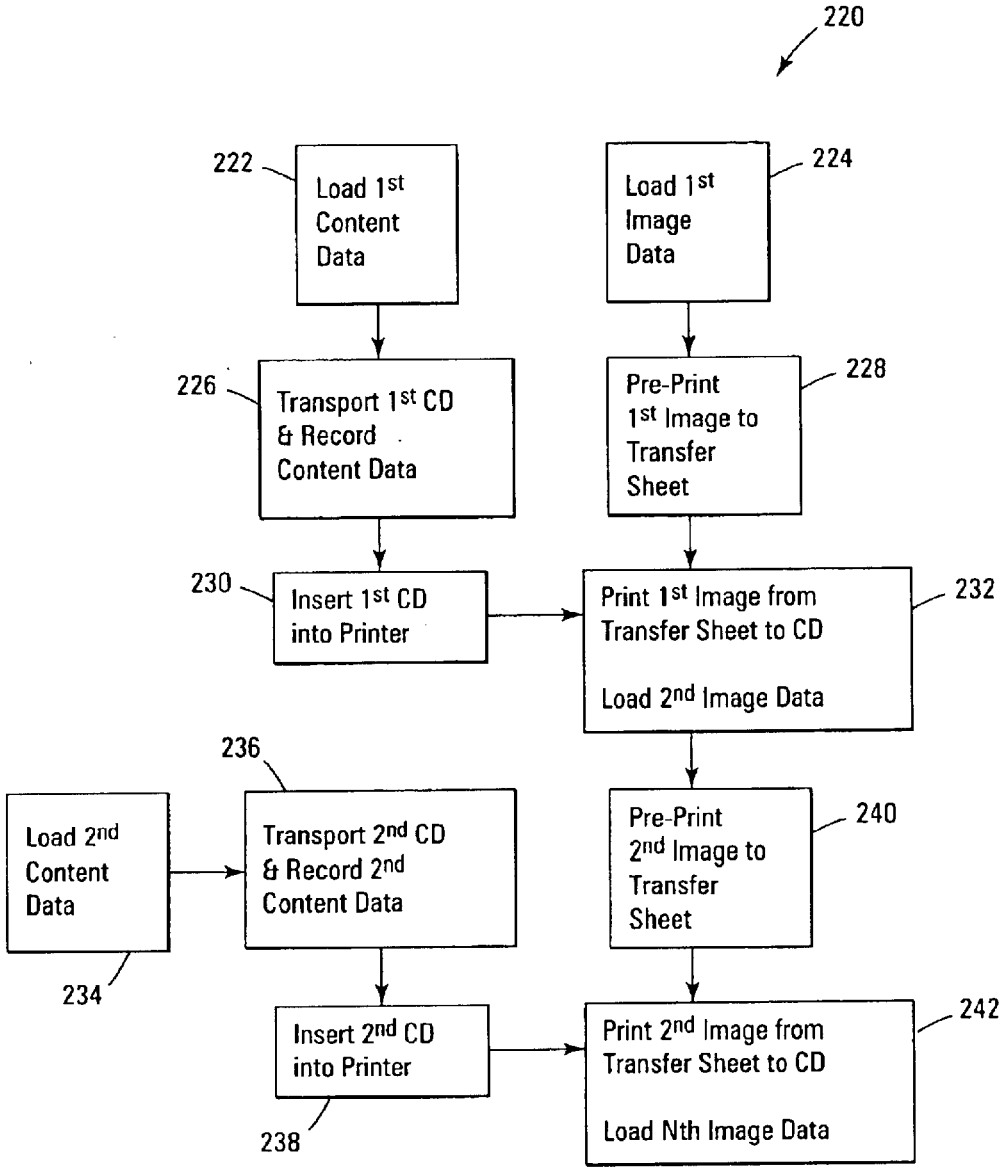
FIG. 4 is a flow chart of another method of the present invention.

Referring to FIG. 4, a flow chart of an alternate method 220 of operating a CD transporter is described. First content data that is to be recorded to a first CD is loaded, 222. Similarly, first image data to produce an image on the first CD is loaded, 224. The first CD is transported to a recorder and the first content data is recorded to the CD, 226. At the same time, the image is printed to the transfer sheet, 228. The first CD is inserted into the printer at 230 and then the first image is transferred from the transfer sheet to the CD, 232. While the image is being printed to the first CD, second image data is loaded. Second content data that is to be recorded to a second CD is loaded, 234. The second CD is transported to a recorder and the second content data is recorded to the CD, 236. At the same time, the second image is printed to the transfer sheet, 240. The second CD is inserted into the printer at 238 and then the second image is transferred from the transfer sheet to the CD, 242.

Figure 5:
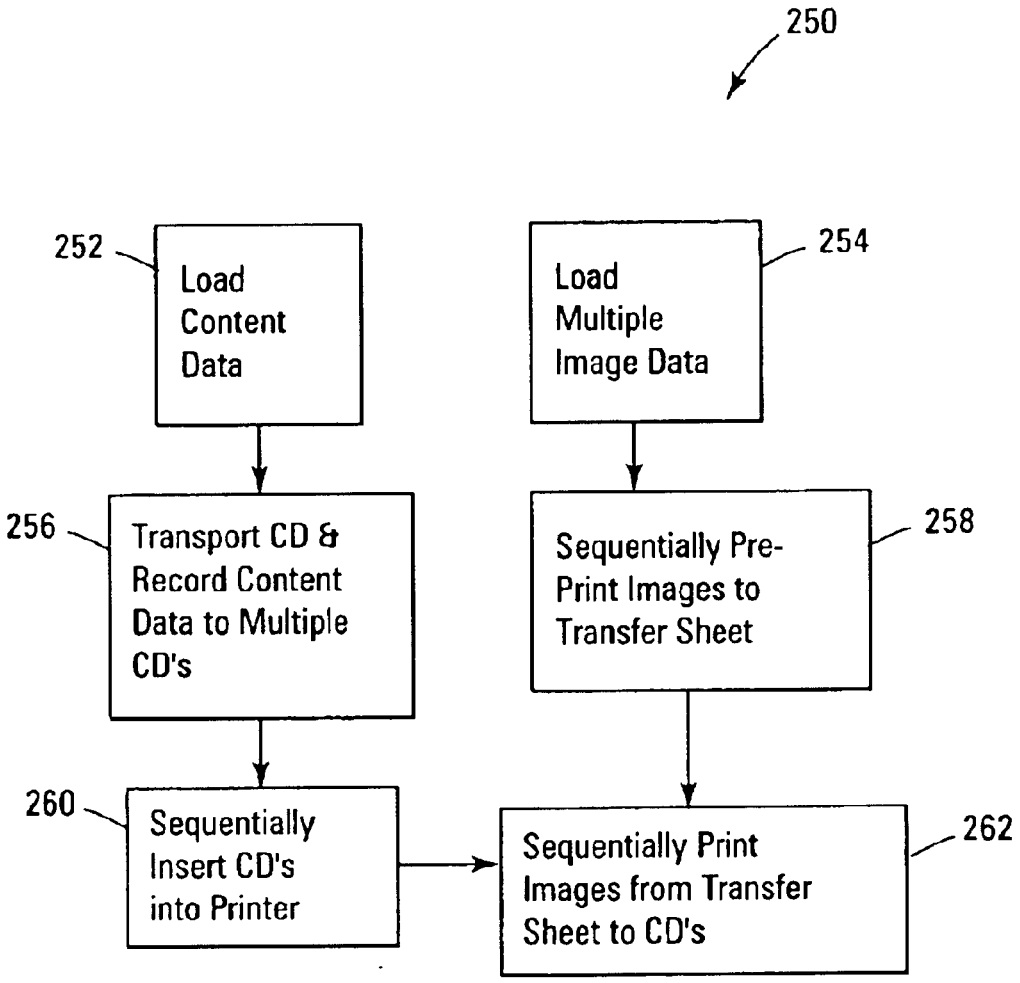
FIG. 5 is a flow chart of another method of the present invention.

Referring to FIG. 5, a flow chart of another method 250 of operating a CD transporter is described. Content data that is to be recorded to CD's is loaded, 252. Similarly, multiple image data to produce images on multiple CD's are loaded, 254. The CD's are transported to a recorder and the content data is recorded to the CD's, 256. At the same time, the images are sequentially printed to the transfer sheet, 258. By parallel processing the images and the CD transporting, the overall time is reduced. The CD's are then sequentially inserted into the printer at 260 and then the image's are transferred from the transfer sheet to the CD, 262.

The above described processing methodology improves CD processing by reducing overall time requirements. For example, a typical printing operation requires 75 seconds to load the CD into the printer, prepare the image, print the CD and remove the CD. By pre-printing the image to a transfer sheet prior to inserting the CD into the printer, the overall printing time is reduced by 25 seconds.

Figure 6:
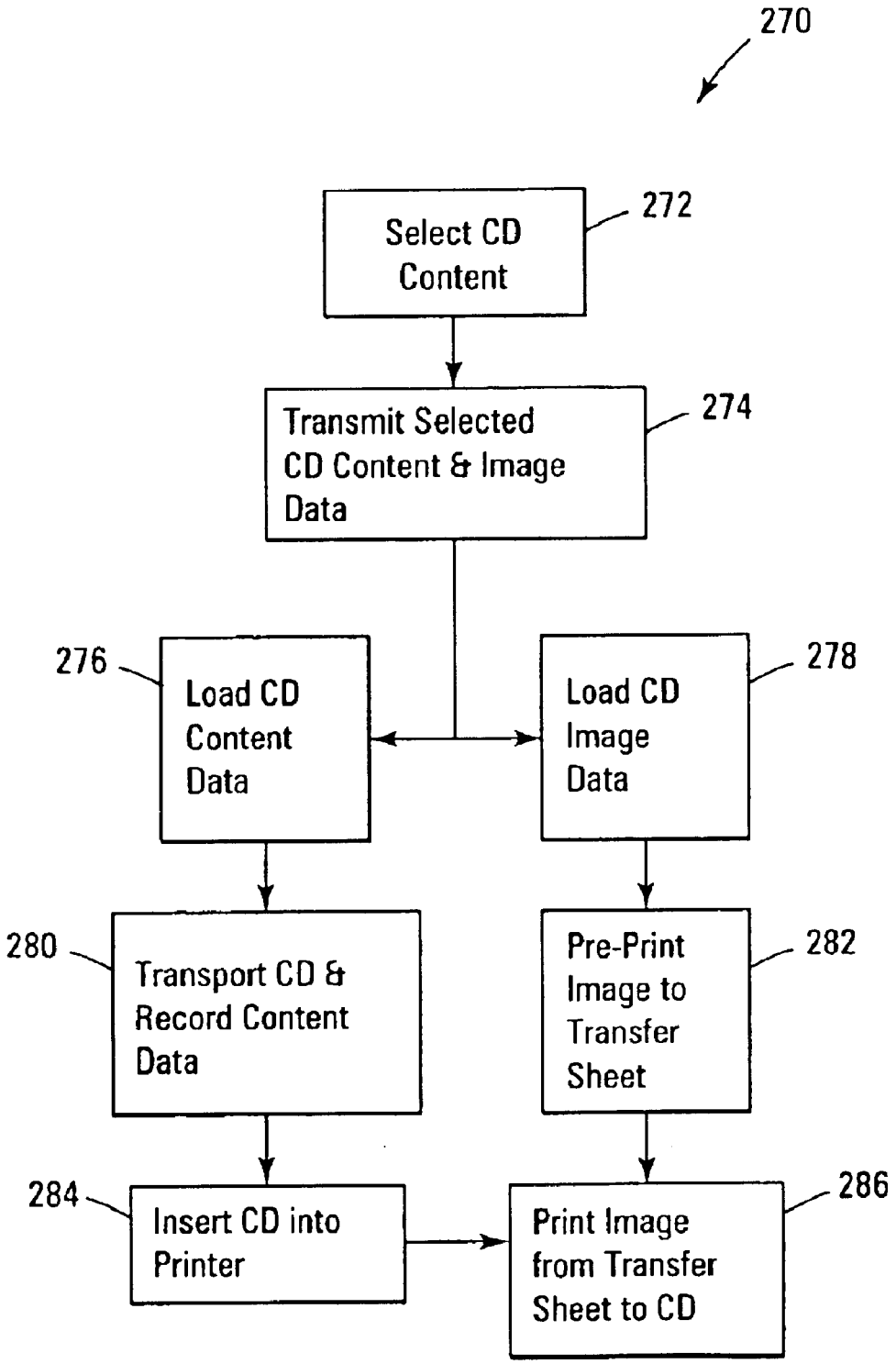
FIG. 6 is a flow chart of a method of the present invention.

Referring to FIG. 6, a flow chart of a business method 270 for delivering content on demand is described. A customer selects desired content for purchase, 272. The content can include, but is not limited to, music, software or video. The selected content is transmitted to the customer location, 274. The received content data that is to be recorded to a CD is loaded, 276. Similarly, image data to re-produce an image on the CD is loaded, 278. The CD is transported to a recorder and the content data is recorded to the CD, 280. At the same time, the image is printed to the transfer sheet, 282. The CD is inserted into the printer at 284 and then the image is transferred from the transfer sheet to the CD, 286.

The retransfer printer 1 is described in detail in Japan patent applications "THERMAL TRANSFER PRINTER", "Method of forming primary transfer image in intermediate transfer system and intermediate transfer printer" and "THERMAL TRANSFER LINE PRINTER" filed May 14, 2001 by Alps Electric Co., LTD, and are incorporated herein by reference. FIGS. 7 to 12 show an embodiment of the thermal transfer line printer 1 in accordance with the present invention. By way of example, the thermal transfer line printer of this embodiment performs printing of full-color image by using a multi-color ink sheet on which color ink regions of five colors of W, K, Y, M and C are arranged such that these regions of different colors appear periodically and repeatedly along the length of the ink sheet, with a color discrimination mark provided at each of the boundary portions of the adjacent ink regions. The K region is used in one embodiment to print indexing marks, and not to print to the primary image.

Figure 7:
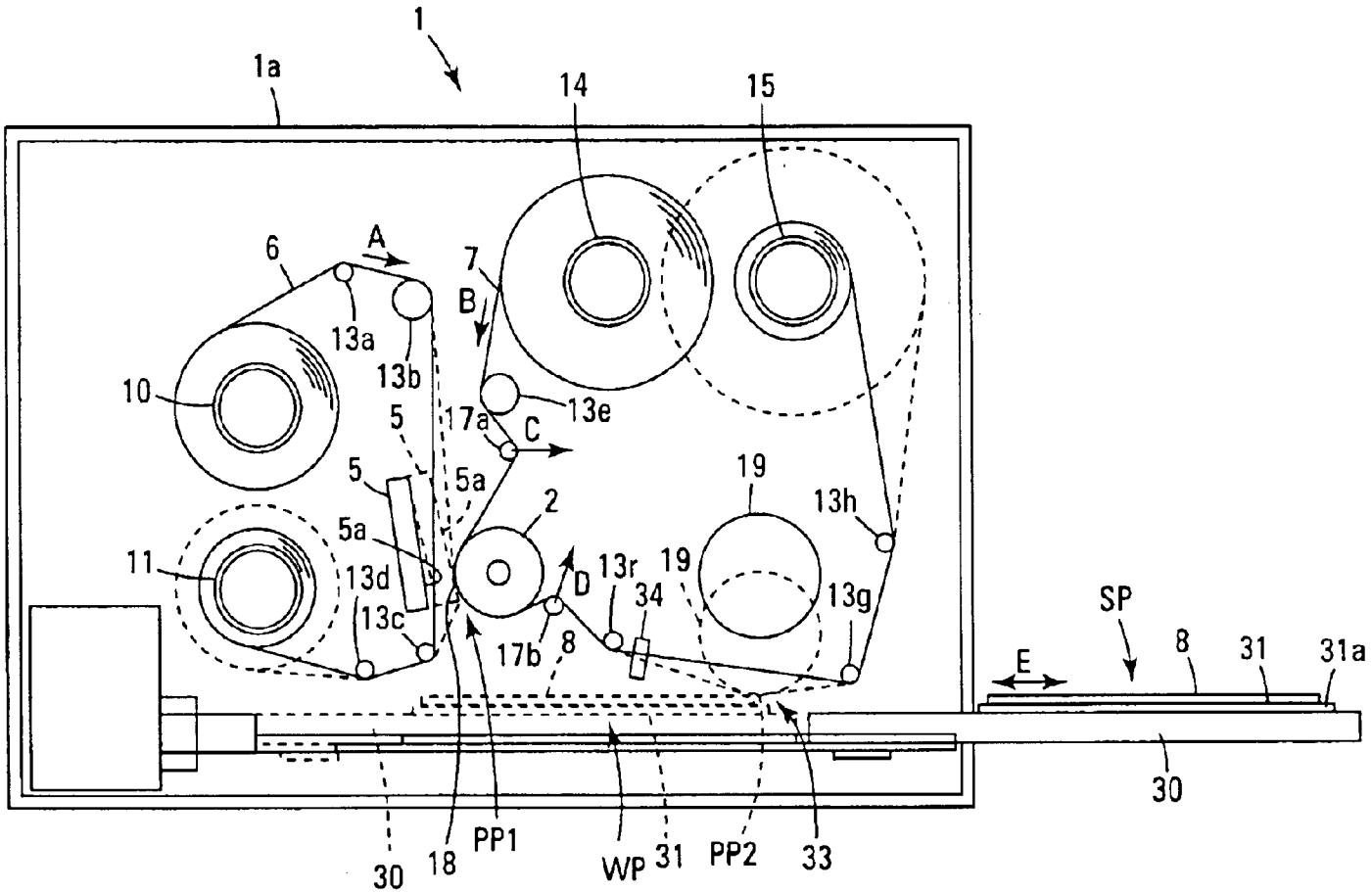
FIG. 7 is a front elevational view showing a critical portion of the line printer.

As shown in FIG. 7, a platen roller 2 is rotatably disposed in the main unit 1*a* of the thermal transfer line printer. The platen roller 2 is driven by the power of a platen drive motor 3 (see FIG. 10) which may be a stepping motor. The platen drive motor 3 is electrically connected to a control section 4 (see FIG. 10) which controls various portions of the thermal line printer. The control section 4 produces various control commands so as to start and stop the platen drive motor 3, as well as to vary the speed and direction of operation of the same.

Referring further to FIG. 7, disposed at the left side of the platen roller 2 as viewed in the figure is a line thermal head 5 which is movable into and out of contact with the platen roller 2, such that the printing surface 5*a* of the thermal head opposes the outer peripheral surface of the platen roller 2. The line thermal head 5 extends in the direction of the axis of the paten roller 2. The printing surface 5*a* of the thermal head 5 has a plurality of heat-generating elements (not shown) arranged over a length which corresponds to the breadth of a multi-color ink sheet 6 and an intermediate transfer sheet 7 as measured in a direction perpendicular to the direction of movement of the multi-color ink sheet 6 as indicated by an arrow A in FIG. 7 and perpendicular also to the direction of movement of the intermediate transfer sheet 7 as indicated by an arrow B in FIG. 7. The length over which the heat-generating elements are formed is determined to be greater than the size of the image to be formed on an objective transfer medium 8 as measured in the direction perpendicular to the direction of movement of the image. The line thermal head 5 is electrically connected to the control section 4 which will be described later so that the heat-generating elements selectively generate heat in accordance with control instructions given by the control section 4 in accordance with printing information.

The line thermal printer 5 is actuated by a head actuating mechanism which is driven by a head actuator motor 9 (see FIG. 10), so as to be selectively set at least to either one of a head-up position shown by a solid line in FIG. 7 where it is spaced from the platen roller 2 and a head-down position shown by a broken line in FIG. 7 where it is pressed against the platen roller 2. The head actuator motor 9 is electrically connected to the control section 4 which will be described later and which performs control of various sections. Thus, the position of the line thermal printer is controlled at a predetermined timing based on control commands delivered from the control section 4.

The multi-color ink sheet 6 and the intermediate transfer sheet 7 are supplied into the region between the platen roller 2 and the line thermal head 5, such that the multi-color ink sheet is positioned between the line thermal head 5 and the intermediate transfer sheet 7.

The multi-color ink sheet 6 is wound on an ink sheet supply roller 10 which is shown at a left part of the printer main unit 1*a* as viewed in FIG. 7 and is taken up by an ink sheet take-up roller 11 disposed under the ink sheet supply roller 10. At least the ink sheet take-up roller 11 is driven to rotate by an ink sheet feed motor 12 (see FIG. 10) which may be a stepping motor, whereby the multi-color ink sheet 6 is unwound from the ink sheet supply roller 10 and is taken up by the ink sheet take-up roller 11. The path and the direction of movement of the multi-color ink sheet 6 are so determined that it runs, as indicated by an arrow A, around four guide rollers 13*a*, 13*b*, 13*c* and 13*d* which are rotatably arranged in the printer main unit 1*a* so as to pass these rollers in the mentioned order, before it is taken up by the ink sheet take-up roller 11. The path of movement of the multi-color ink sheet 6 is so determined that the back side of the multi-color ink sheet 6, opposite to the side having the ink regions, opposes the line thermal head 5. The ink sheet feed motor 12 is connected to the control section 4 which will be described later and which control various sections. Thus, the ink sheet feed motor 12 is stopped, started and speed-controlled in accordance with control commands given by the control section 4.

The intermediate transfer sheet 7 is wound on an intermediate transfer sheet supply roller 14 which is shown at an upper right side of the platen roller 2 of the printer main unit 1*a* as viewed in FIG. 7 and is taken up by an intermediate transfer sheet take-up roller 15 which is disposed at the upper right corner of the printer main unit 1*a* as viewed in FIG. 7. At least the intermediate transfer sheet take-up roller 15 is driven to rotate by an intermediate sheet feed motor 16 (see FIG. 10), whereby the intermediate transfer sheet 7 is unwound from the intermediate transfer sheet supply roller 14 and is taken up by the intermediate transfer sheet take-up roller 15. The path and the direction of movement of the intermediate transfer sheet 7 are so determined that it runs, as indicated by an arrow B, around a guide roller 13*e* and a tension roller 17*a* which are rotatably arranged in the printer main unit 1*a*, and then runs along the outer peripheral surface of the platen roller 2 and thereafter runs around a tension roller 17 *b* and three guide rollers 13*f*, 13*g*, 13*h* which are rotatably arranged in the printer main unit 1*a* so as to pass these rollers in the mentioned order, before it is taken up by the intermediate transfer sheet take-up roller 15.

The pair of tension rollers 17*a* and 17*b* arranged upstream and downstream of the platen roller 2 so as to face the path of the intermediate transfer sheet 7 serve to maintain a predetermined tension on the intermediate transfer sheet 7. The tension roller 17*a* which is disposed at the upper side (upstream) of the platen roller 2 contacts the intermediate transfer sheet 7 so as to urge this sheet 7 rightward as viewed in the figure as indicated by an arrow C. The tension roller 17*b* arranged at the lower side (downstream) of the platen roller 2 contacts the intermediate transfer sheet 7 so as to urge this sheet obliquely, i.e., upward and rightward as viewed in FIG. 7, as indicated by an arrow D.

If there is no need for feeding the intermediate transfer sheet 7 backward, the upstream tension roller 17*a* may be omitted: namely, it suffices only to provide the downstream tension roller 17*b*.

The path of movement of the intermediate transfer sheet 7 is determined such that it overlaps the multi-color ink sheet 6 in the region where the sheet 7 contacts the platen roller 2. In this region, the intermediate transfer sheet 7 faces the ink regions on the multi-color ink sheet 6.

In this embodiment, the intermediate transfer sheet supply roller 14 and the intermediate transfer sheet take-up roller 15 are power-driven by an intermediate transfer sheet feed motor 16 which is, for example, a reversible stepping motor. For instance, the arrangement is such that the power of the intermediate transfer sheet feed motor 16 is selectively transmitted to either one of an intermediate transfer sheet supply roller drive gear and an intermediate transfer sheet take-up roller drive gear, through an oscillatable gear which is provided on the output end of a gear train. When the power of the intermediate transfer sheet feed motor 16 is transmitted to the intermediate transfer sheet take-up roller drive gear, the intermediate transfer sheet is unwound from the intermediate transfer sheet supply roller 14 and taken-up by the intermediate transfer sheet take-up roller 15. Conversely, when the power of the intermediate transfer sheet feed motor 16 is transmitted to the intermediate transfer sheet supply roller drive gear, the intermediate transfer sheet supply roller is driven backward so that the intermediate transfer sheet is moved backward: namely, unwound from the intermediate transfer take-up roller 15 and rewound on the intermediate transfer sheet supply roller 14. The use of a single common intermediate transfer sheet feed motor 16 is not exclusive. Namely, it is possible to use separate intermediate transfer sheet feed motors 16, 16, one for the intermediate transfer sheet supply roller and the other for the intermediate transfer sheet take-up roller.

The intermediate transfer sheet 7 used in the illustrated embodiment is made of an elongated transparent resin film or a sheet of, for example, polyethylene terephthalate (PET). The film or sheet may be coated with a material which assists retransfer of an image from the intermediate transfer sheet to an objective transfer medium. The breadth of the intermediate transfer sheet 7 as measured in the direction perpendicular to the direction B of movement thereof is substantially the same as that of the multi-color ink sheet 6. The material of the intermediate transfer sheet 7 has a wide selection, e.g., a thin sheet of paper, a resin film and so on, provided that the material permits transfer of ink from the multi-color ink sheet 6 and re-transfer of the ink to the objective transfer medium 8 therefrom.

The platen roller 2 and the line thermal head 5 in cooperation form a primary image forming section 18 which transfers inks from the multi-color ink sheet 6 to the intermediate transfer sheet 7 so as to form an inverse or reversal primary image on the intermediate transfer sheet 7.

As explained before, the line thermal head 5 in the head-down position as shown by broken line in FIG. 7 contacts the platen roller 2 at a predetermined pressure of contact. The region where the line thermal printer 5 in this head-down position contacts the platen roller 2 is defined as an intermediate transfer position PP1 at which the reversal primary image is formed on the intermediate transfer sheet 7.

Figure 10:
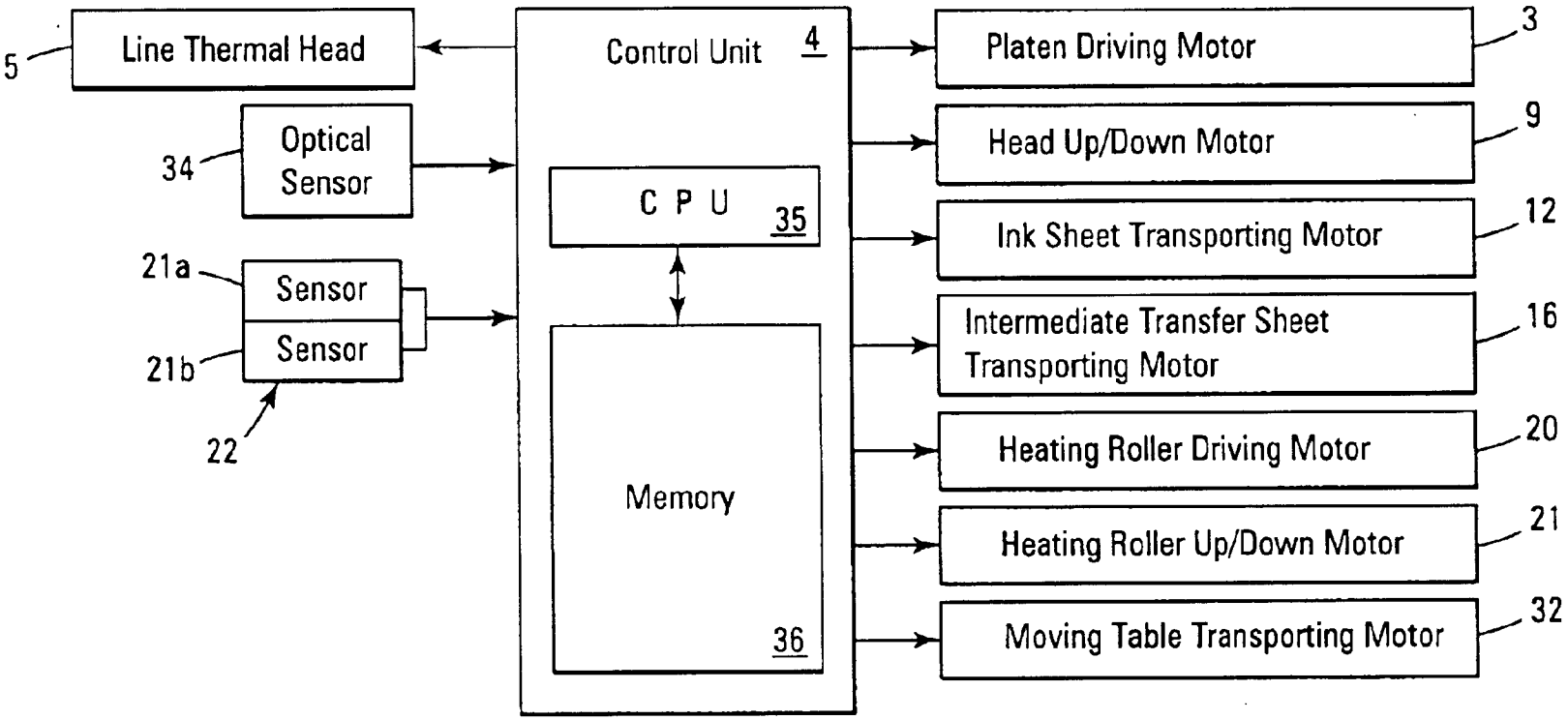
FIG. 10 is a block diagram showing the configuration of a critical portion of a control section.

A heating roller 19 serving as re-transfer mechanism is disposed downstream of the primary image forming section 18 as viewed in the direction of feed of the intermediate sheet 7, more specifically as the right side of the platen roller 2 as viewed in FIG. 7, so as to downwardly face the path of movement of the intermediate transfer sheet 7. The heating roller 19 is driven to rotate by the power of a heating roller drive motor 20 (see FIG. 10) which may be a stepping motor. The heating roller 19 also is adapted to be selectively set at least to one of a spaced position which is shown by a solid line in FIG. 7 and at which the heating roller 19 is spaced from the intermediate transfer sheet 7 and a pressure-contact position which is shown by a broken line in FIG. 7 and at which the heating roller 19 is held in pressure contact with the intermediate transfer sheet 7, by means of a heating roller actuating mechanism 22 which will be described later and which is driven by a heating roller actuator motor 21 (FIG. 10). The heating roller drive motor 20 and the heating roller actuator motor 21 are electrically connected to the control section 4 which will be detailed later and which controls operations of various sections. The rotation and the position of the heating roller are controlled at predetermined timings based on control commands given by the control section 4.

Figure 8:
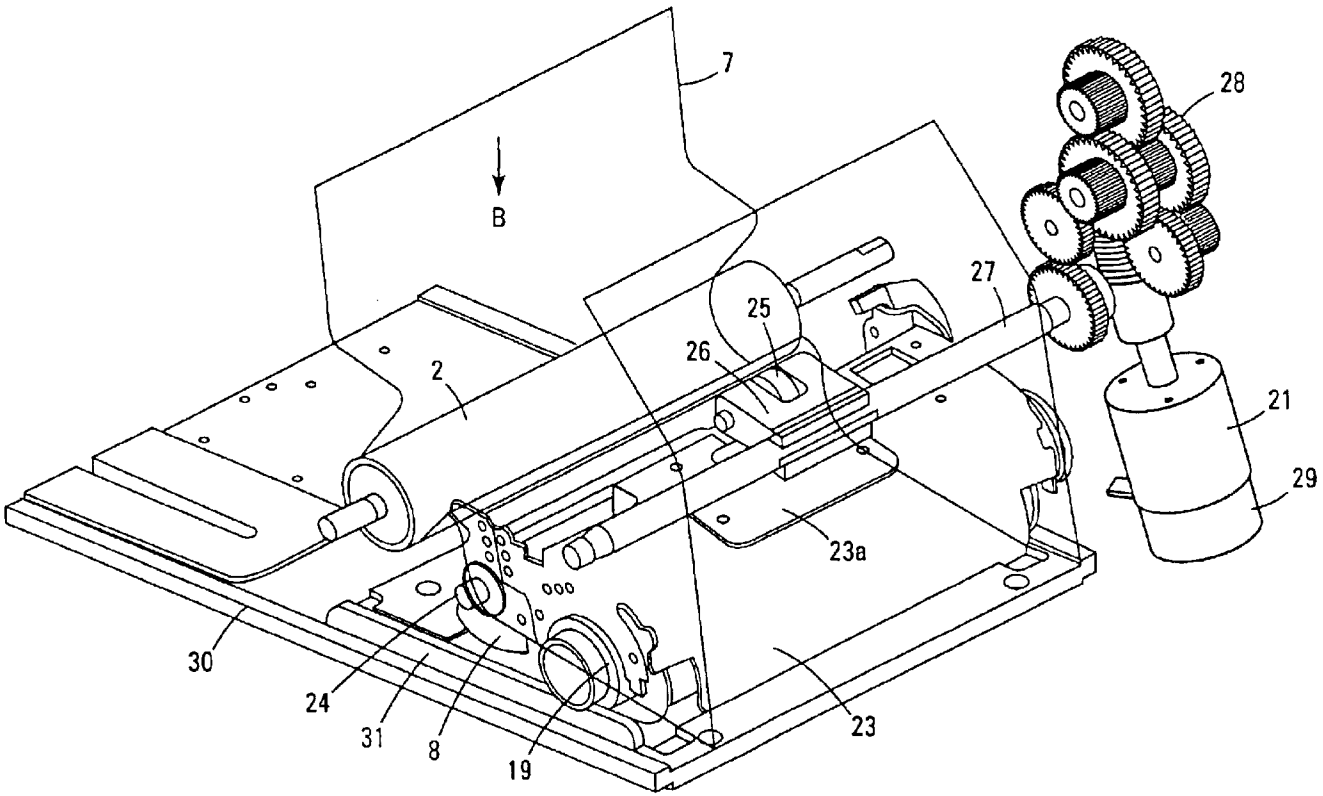
FIG. 8 is a perspective view of the line printer of FIG. 7 showing particularly a portion including heating roller and therearound.

The heating roller actuating mechanism 22 will be described with specific reference to FIGS. 8 and 9. As will be seen from these Figures, the heating roller actuating mechanism 22 used in this embodiment has a heating roller support frame 23 which rotatably supports the heating roller 19 at both ends thereof. As will be seen from FIG. 9, the heating roller support frame 23 is mounted pivotally for a pivot motion about an axis presented by a pivot shaft which is rotatably carried by a mounting frame (not shown). The heating roller support frame 23 is normally urged counterclockwise as viewed in FIG. 9 about the axis of the pivot pin 24, by the force of an urging spring which is not shown. The counterclockwise rotation of the heating roller support frame 23 is stopped by a stopper which is not shown, so that the heating roller 19 is normally held at the spaced position above the intermediate transfer sheet 7. A pressure-contact member 25, which is disposed above the top plate 23*a* of the heating roller support frame 23, is movable into and out of contact with the heating roller support frame 23. The pressure-contact member 25 is rotatably supported between two branches of a bifurcated pressure-contact-member support arm 26 the base end of which is fixed to a rotary support shaft 27 rotatably supported on the mounting frame (not shown). The rotary support shaft 27 is driven to rotate by power which is transmitted from the heating roller actuator motor 21 via a gear train 28.

Figure 9:
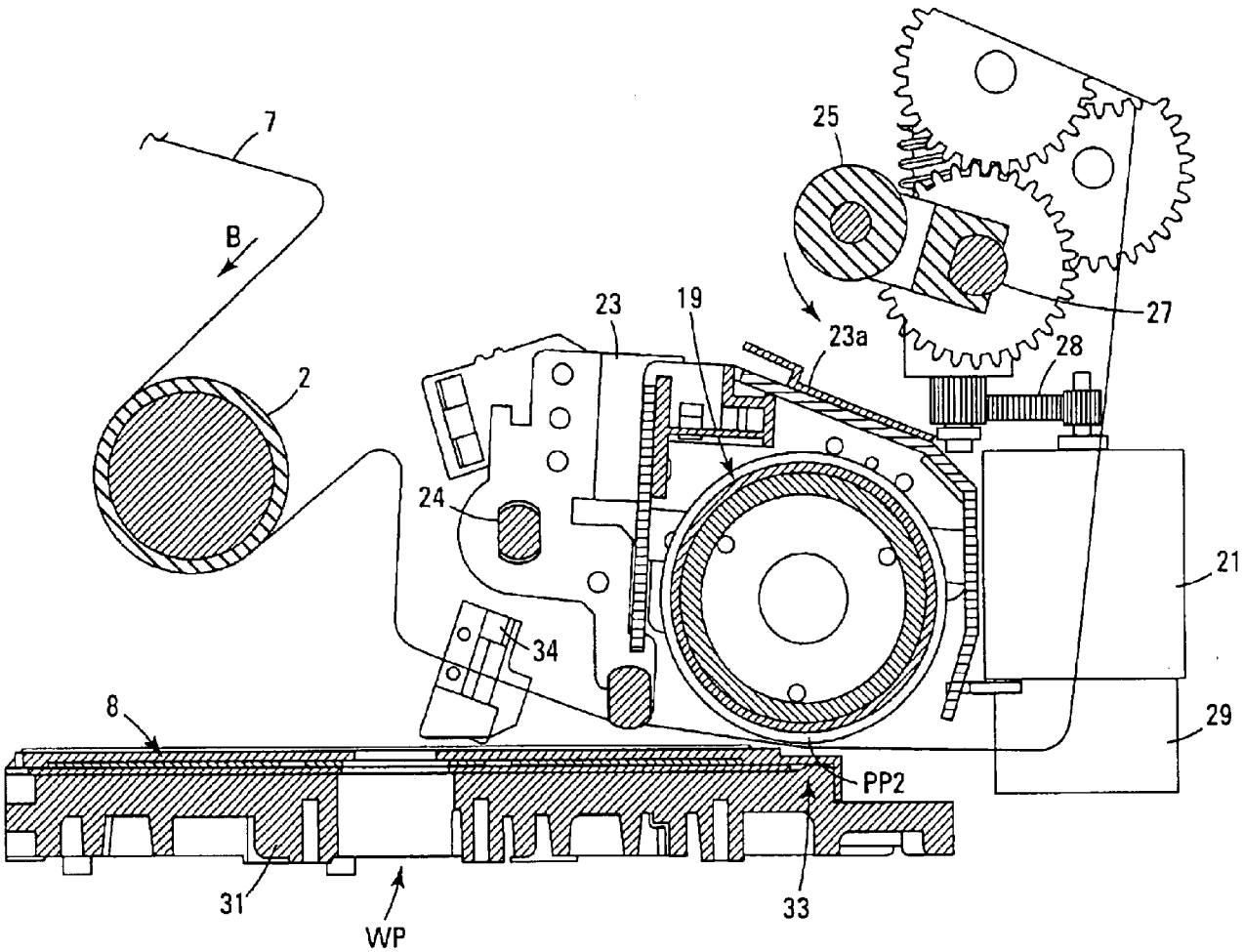
FIG. 9 is an enlarged sectional view of a portion of the line printer in a state in which a heating roller has been held in pressure contact with an intermediate transfer sheet.

When the heating roller 19 is set at the spaced position spaced from the intermediate transfer sheet 7 as shown by the solid line in FIG. 7, the pressure-contact member 25 is spaced from the top plate 23*a* of the heating roller support frame 23, whereas, when the heating roller 19 is set at the pressure-contact position where it makes pressure contact with the intermediate transfer sheet 7 as shown y broken line in FIG. 7, the pressure-contact member 25 is held in pressure contact with the top plate 23*a* of the heating roller support frame 23, as shown by a solid line in FIG. 9.

Thus, the arrangement is such that the pressure-contact member 25 is moved into and out of contact with the top plate 23*a* of the heating roller support frame 23 by the power of the heating roller actuator motor 21, so that the heating roller support frame 23 is caused to pivot about the axis of the pivot pin 24, whereby the heating roller 19 is selectively set to one of the spaced position where the heating roller is spaced from the intermediate transfer sheet 7 and the pressure-contact position where the same makes pressure contact with the intermediate transfer sheet 7.

An encoder 29 is associated with the heating roller actuator motor 21 so as to detect the speed of rotation of the shaft of the heating roller actuator motor 21 and to deliver a speed signal to the control section 4.

In the illustrated embodiment, there are two states of pressure contact between the heating roller 19 and the intermediate transfer sheet 7: a weak pressure contact state and a strong pressure contact state, as will be described later.

The described construction of the heating roller actuator mechanism 22 is not exclusive, and other construction may be employed for this mechanism provided that it can actuate the heating roller 19 into and out of contact with the intermediate transfer sheet 7 by the power of the heating roller actuator motor 21.

In the illustrated embodiment, the arrangement is such that an objective transfer medium 8, which is in this case a CD (Compact Disk) is supplied to a region beneath the heating roller 19 so as to oppose the heating roller 19 across the intermediate transfer sheet 7. The objective transfer medium 8 is detachably secured to a tray 31 which is mounted on a tabular carriage 30. The carriage 30 reciprocates as indicated by a double-headed arrow E to the left and right as viewed in FIG. 7, by the power of a carriage drive motor 32 (see FIG. 10), so that the objective transfer medium 8 is selectively moved reciprocately at least to a supply/delivery position SP shown by a solid line in FIG. 7 and a re-transfer stand-by position WP shown by a broken line in FIG. 7.

The arrangement is such that, as shown in FIG. 9, the edge 31*a* of the upper surface of the tray 31 at the re-transfer stand-by position WP, which is shown at the right side in FIG. 9 and which is adjacent to the supply/delivery position SP, opposes the lower end of the heating roller 19 which is at the pressure-contact position.

The carriage drive motor 32 is electrically connected to the control section 4, so that the start and stop, operation speed and the operating direction of the carriage drive motor 32 are controlled in accordance with control commands given by the control section 4.

The objective transfer medium 8 set at the supply/delivery position SP is exposed to the exterior of the printer main unit 1*a*, so as to be easily loaded on and unloaded from the carriage 30.

Although the objective transfer medium is described as being a CD, this is only illustrative and various types of media can be used as the objective transfer medium such as a CD-R, MO, DVD, stock certificate, securities, certificates, pass books, tickets such as those for public transport, museum, theater and movie, cash card, credit card, prepaid card, postcard, calling card, IC card, optical disk, calendar, poster, brochure, accessory, stationary goods, and so forth. Any material that will not be thermally deformed due to heat applied during the re-transfer may be used as the material of the objective transfer medium, such as a sheet of paper, resin, glass, metal, ceramics, cloths, and so on.

The heating roller 19 provides a re-transfer section 33 in which the primary image formed on the intermediate transfer sheet 7 is re-transferred to the objective transfer medium 8 to form an image on the latter.

The region at which the heating roller 19 is held at the pressure-contact position to make a pressure contact with the objective transfer medium 8 at a predetermined pressure, shown by the broken line in FIG. 7, is defined as a re-transfer region PP2 in which the primary image formed on the intermediate transfer sheet 7 is re-transferred to the objective transfer medium 8 to form an image on the latter.

As shown in FIG. 9, a photo-sensor 34, which in this case is a reflective sensor, is disposed between the platen roller 2 and the heating roller 19, more specifically between the guide roller 13*f* and the heating roller 19, so as to downwardly face the path of movement of the intermediate transfer sheet 7. The photo-sensor 34 serves as a re-transfer mark detector for detecting an alignment mark formed on the intermediate transfer sheet 7, in order to precisely locate the primary image to be retransferred. The photo-sensor 34 is electrically connected to the control section 4, so as to send an alignment detection signal to the control section 4.

As shown in FIG. 10, the control section 4 which performs overall control of various sections of the thermal transfer printer 1 of this embodiment has at least a CPU 35 and a memory 36 including a ROM and a RAM of suitable storage capacities. To the control section 4 are connected at least the platen drive motor 3, the line thermal head 5, the head actuator motor 9, the ink sheet feed motor 12, the intermediate transfer sheet feed motor 16, the heating roller drive motor 20, the heating roller actuator motor 21, the carriage drive motor 32 and the photo-sensor 34. Electrically connected also to the control section are warning and indicating means such as pilot lamps and buzzer for informing the operator of any error, and various known switches for enabling entry of various printing operation instructions including a power switch.

The memory 36 stores a program for controlling the heating roller actuator motor 21 such that the heating roller actuator mechanism 21 can take, at least when the re-transfer of the image is performed, either one of the weak contact state in which the heating roller 19 is pressed against the intermediate transfer sheet 7 at a weak pressure and the strong contact state in which the same is strongly pressed against the intermediate transfer sheet 7.

Preferably, the program is designed such that the heating roller 19 is held in the weak contact state before the photo-sensor detects an alignment mark and, starting from the moment at which the photo-sensor has detected the alignment mark, the state of contact is switched to the strong contact state to bring the heating roller into strong contact with the intermediate transfer sheet 7.

Thus, the timing at which the state of contact is switched from the weak to strong is determined to be the moment at which the objective transfer medium 8 reaches the re-transfer region PP2 and at the moment at which the leading end of the objective transfer medium 8 which is being conveyed from the re-transfer stand-by position WP towards the supply/delivery position SP has reached the re-transfer region PP2.

The control of the switching between the weak contact state and the strong contact state is executed by the program, in accordance with the result of detection of the speed of operation of the heating roller actuator motor 21 performed by the encoder 29.

More specifically, the operation speed of the heating roller actuator motor 21 varies such that the speed is constant while the pressure contact member 25 is spaced away from the top plate 23*a* of the heating roller support frame 23 because in such a state no load is applied to the heating roller actuator motor 21, whereas, when the pressure contact member 25 is brought into contact with the top plate 23*a* of the heating roller support frame 23, the heating roller actuator motor is loaded to progressively decrease its operation speed. In this embodiment, the relationship between the operation speed of the heating roller actuator motor 21 and the level of the contact pressure is obtained beforehand through a measurement. A position where a predetermined motor speed has been reached after the start of deceleration of the motor is determined as being the weak contact position and a position which is reached after further rotation of the motor shaft by an amount corresponding to a predetermined number of pulses from the weak contact position is determined as being the strong contact position.

With this arrangement, it is possible to control the operation timings for bringing the heating roller 19 into the strong contact state and switching the state of contact from the weak contact state to the strong contact state, using as the time reference the moment at which the alignment mark is detected by the photo-sensor 34.

The memory 36 also stores various other programs such as the programs for controlling the operations of various sections and operation sequence, and a program for performing initialization after turning on of the power supply, as well as various kinds of data such as the data necessary for the intermediate transfer and the re-transfer of the images.

The operation of the described embodiment of the thermal transfer line printer is as follows. The image forming operation per se, for forming an image on the objective transfer medium 8 by the thermal transfer line printer 1, is basically the same as those performed by ordinary thermal transfer line printers and, therefore, the following description will be focused mainly on the features unique to the present invention.

For the purpose of executing the re-transfer, the heating roller actuator motor 21 is started in accordance with a control command given by the control section 4, at a moment before the alignment mark formed on the intermediate transfer sheet 7 is detected by the photo-sensor 34, e.g., at a moment at which the primary image formed on the intermediate transfer sheet 7 leaves the intermediate transfer region PP1 for the re-transfer region PP2. As a result, the pressure-contact member 25 is swung counterclockwise as viewed in FIG. 9, about the axis of the rotary shaft 27. The pressure-contact member 25 which is being swung counterclockwise is the brought into contact with the top pate 23*a* of the heating roller support frame 23 from the upper side of the top plate 23*a*. Consequently, the heating roller actuator motor 21 is gradually loaded to decelerate and, when the encoder 29 has detected that the operation speed of the heating roller actuator motor 21 has been lowered to the predetermined speed, heating roller actuator motor 21 is de-energized, whereby the heating roller 19 is held in the weak contact state in which the heating roller 19 contacts with the intermediate transfer sheet 7 at a small contact pressure from the upper side of the intermediate transfer sheet 7.

In this state, the objective transfer medium 8 has been moved to the retransfer stand-by position WP as shown in FIG. 9, so that the edge 31*a* of the tray 31 has been brought into contact with the lower end of the heating roller 19 which is held in the weak contact state. The intermediate transfer sheet 7 is fed while making the weak contact with the heating roller 19 and, in the course of movement of the primary image formed on the intermediate transfer sheet 7 from the intermediate transfer region PP1 towards the re-transfer region PP2, the alignment mark which is on the leading side of the primary image as viewed in the direction of movement of this image is detected by the photo-sensor 34. The heating roller 19, when held in contact with the intermediate transfer sheet 7, rotates as the intermediate transfer sheet 7 is fed.

The control section 4, upon receipt of a detection signal from the photo-sensor 34 indicative of the detection of the alignment mark on the intermediate transfer sheet 7, produces a control command indicative of execution of the re-transfer operation. In response to this control command, a cueing operation is conducted using the alignment mark as the position reference so as to bring the leading end of the primary image as viewed in the direction of the movement to the re-transfer stand-by position WP which is provided at the left side of the re-transfer region PP2 as viewed in FIG. 9, whereby the primary image and the objective transfer medium 8 are aligned to each other while they are at the re-transfer stand-by position.

After the alignment between the primary image and the objective transfer medium 8 is achieved in the re-transfer stand-by position WP, the heating roller 19 is driven and, at the same time, the intermediate transfer sheet feed motor 16 and the carriage drive motor 32 are activated to as to cause the intermediate transfer sheet 7 and the objective transfer medium 8 to move at the same speed in the same direction. In synchronization with the arrival of the leading ends of the primary image and the objective transfer medium at the re-transfer region PP2, the heating roller actuator motor 21 is activated, whereby the state of contact of the heating roller 19 is switched to the strong contact state simultaneously with the arrival of the above-mentioned leading ends at the re-transfer region PP2.

The primary image and the objective transfer medium 8 then move through the re-transfer region PP2 while undergoing the pressure and heat applied by the heating roller 19 which is now in its strong contact state, whereby the primary image formed on the intermediate transfer sheet 7 is progressively transferred to the objective transfer medium 8, thus forming the desired image on the objective transfer sheet 8.

As will be understood from the foregoing description, in the thermal transfer line printer of this embodiment, the pressure at which the heating roller 19 is pressed onto the intermediate transfer sheet 7 during execution of the re-transfer operation is controlled in two stages: initially with a small pressure of contact to realize the weak contact state and then with a large pressure to realize the strong contact state, thus avoiding any impacting or drastic change of the load applied to the intermediate transfer medium 7. This effectively eliminates or suppresses any problem such as wrinkling of the intermediate transfer sheet 7 at the portion of the latter contacting the leading end of the objective transfer medium 8, floating of the trailing end of the objective transfer medium 8 above the tray 31, and so on.

Another advantage of the thermal transfer line printer of this embodiment is derived from the feature that the alignment mark on the intermediate transfer sheet 7 is detected while the heating roller 19 is held in the weak contact with the intermediate transfer sheet 7. Namely, undesirable offset between the primary image and the objective transfer medium 8, which otherwise may be caused when the heating roller 19 is brought into contact with the intermediate transfer medium, can advantageously be avoided.

Figure 11:
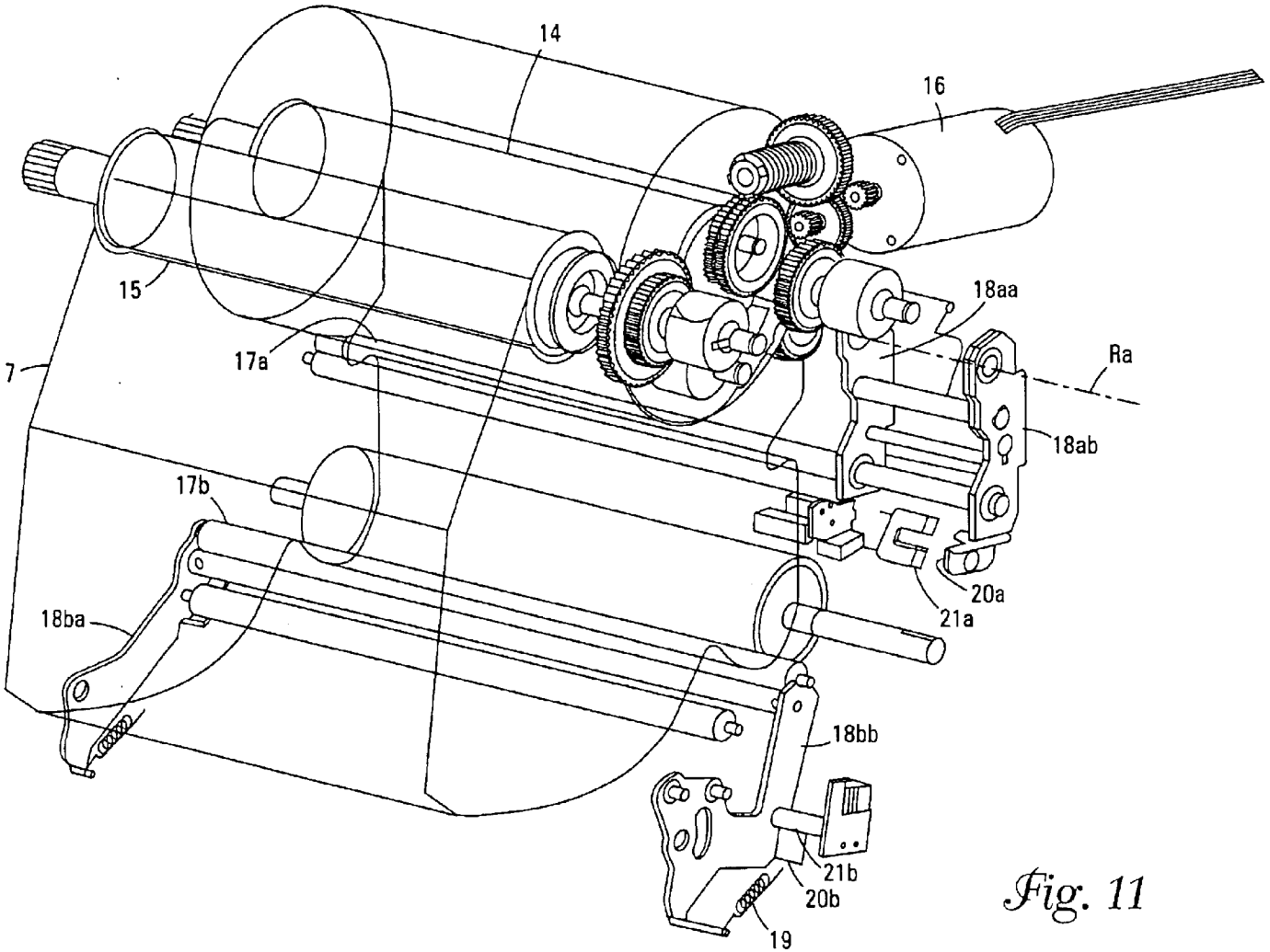
FIG. 11 is a perspective view of the principal components shown in FIG. 7.

As shown in FIG. 11, the tension roller 17*a* positioned to the upper side of the platen roller 2 is rotatably borne on one side by a pair of tension roller supporting frames 18*aa* and 18*ab*. Also, the tensions roller 17*b* positioned to the left side of the platen roller 2 is rotatably borne on both sides by a pair of tension roller supporting frames 18*ba* and 18*bb*. The tension roller supporting frames 18*aa* through 18*bb* are rotatably supported by an unshown assembly frame, with the tension roller supporting frames 18*aa* and 18*ab* shown to the upper side in FIG. 11 being rotatably formed around a rotational center Ra indicated by the chain line at the upper side of FIG. 11, and the tension roller supporting frames 18*ba* and 18*bb* shown to the lower upper side in FIG. 11 being rotatably formed around a rotational center Rb indicated by the chain line at the lower side of FIG. 11. Further, the tension roller supporting frame 18*aa* shown to the upper side in FIG. 11 and the tension roller supporting frame 18*bb* shown to the lower side in FIG. 11 are linked by linking plate, such that the tension roller supporting frames 18*aa* through 18*bb* operate synchronously. Moreover, one end of a compression coil spring 19 is attached to the tension roller supporting frame 18*bb* shown to the lower side in FIG. 11, and the other end of the compression coil spring 19 is attached to an attaching frame not shown in the figures. Accordingly, the tension roller supporting frames 18*ba* and 18*bb* shown to the lower upper side in FIG. 11 are forced in a counter-clockwise direction around the rotating center Rb, and the tension roller supporting frames 18*aa* and 18*ab* shown to the upper side in FIG. 11 are forced in a clockwise direction around the rotating center Ra. Thus, the tension roller supporting frames 18*aa* through 18*bb* are configured so as to press the tension rollers 17*a* and 17*b* against the intermediate transfer sheet 7.

As shown in FIG. 11, the two tension roller supporting frames 18*ab* and 18*bb* at the upper right and lower right in FIG. 11 have base portions of detectors 20*a* and 20*b* formed in generally plate-shaped formed, attached thereto respectively. Sensors 21*a* and 21*b* formed of optical sensors (photo-interrupters) are respectively disposed to the tops of the detectors 20*a* and 20*b*, such that the position of the detectors 20*a* and 20*b* can be detected by shielding or opening the sensors 21*a* and 21*b* with the detectors 20*a* and 20*b*. These sensors 21*a* and 21*b* are electrically connected to the control unit 4 (see FIG. 10) for controlling the action of the later-described parts, such that the detectors 20*a* and 20*b* can send detection signals relating to shielding or opening of the sensors 21*a* and 21*b*, to the control unit 4.

The sensors 21*a* and 21*b* and the detectors 20*a* and 20*b* make up tension roller position detector 22 for detecting the position of the tension rollers 17*a* and 17*b* according to the present embodiment. Detection of the position of the tension rollers 17*a* and 17*b* will be described later.

Figure 12:
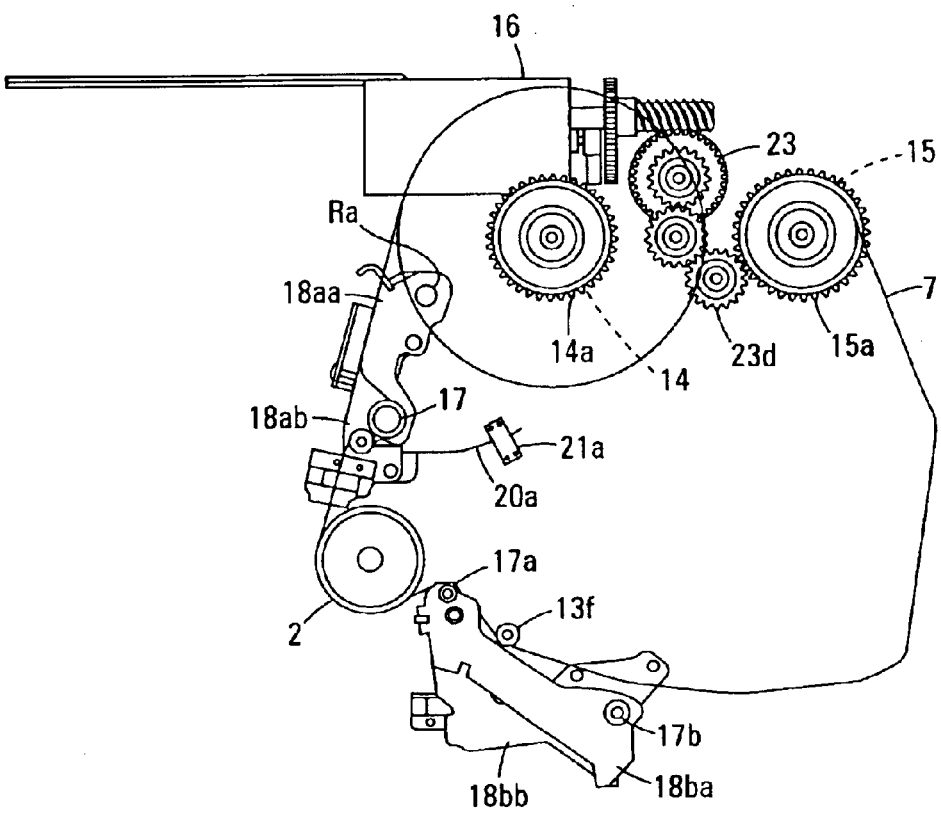
FIG. 12 is a rear view of the arrangement shown in FIG. 11.

As shown in FIG. 12, the intermediate transfer sheet feeding roller 14 and the intermediate transfer sheet take-up roller 15 are formed so as to be rotatably driven by the driving force of an intermediate transfer sheet transporting motor 16 which is formed of a pulse motor or servo motor capable of forward and reverse rotations, or the like. That is, the driving force of the intermediate transfer sheet transporting motor 16 is selectively transmitted to either an intermediate transfer sheet feeding roller driving gear 14*a* or an intermediate transfer sheet take-up roller driving gear 15*b* via an oscillating gear 23*a* provided at the output end of a gear train 23, such that rotating driving of an intermediate transfer sheet take-up roller driving gear 15*a* with the driving force of the intermediate transfer sheet transporting motor 16 causes the intermediate transfer sheet 7 to be fed off of the intermediate transfer sheet feeding roller 14 and be wound into the intermediate transfer sheet take-up roller 15. Also, rotating the intermediate transfer sheet take-up roller driving gear 14*a* with reverse driving force of the intermediate transfer sheet transporting motor 16 causes the intermediate transfer sheet 7 to be reversibly transported from the intermediate transfer sheet take-up roller 15 side to the intermediate transfer sheet feeding roller 14 side. Note that an arrangement may also be made wherein the intermediate transfer sheet take-up roller driving gear 14*a* and the intermediate transfer sheet take-up roller driving gear 15*a* are each independently driven by separate intermediate transfer sheet transporting motors 16.

The action of forming an image into the transfer medium 1 with the thermal transfer line printer according to the present embodiment is the same as that of a conventional thermal transfer line printer, so detailed description thereof will be omitted, and description will be made regarding only the essence of the present invention.

With the thermal transfer line printer 1 according to the present embodiment, the transfer sheet transporting motor 16 is controlled such that the detectors 20*a* and 20*b* are positioned within the detecting range of the sensors 21*a* and 21*b* at the time of transporting the intermediate transfer sheet 7.

That is to say, at the time of transporting the intermediate transfer sheet 7, in the event that the detectors 20*a* and 20*b* are positioned within the detecting range of the sensors 21*a* and 21*b*, detection signals wherein the detectors 20*a* and 20*b* have shielded the sensors 21*a* and 21*b*, OFF signals for example, are sent to the control unit 4. Also, in the event that the detectors 20*a* and 20*b* have exceeded the detecting range of the sensors 21*a* and 21*b*, detection signals wherein the detectors 20*a* and 20*b* have opened the sensors 21*a* and 21*b*, ON signals for example, are sent to the control unit 4.

The control unit 4 then controls the transfer sheet transporting motor 16 such that the detectors 20*a* and 20*b* are maintained within the detecting range of the sensors 21*a* and 21*b*, which in the present embodiment is realized by controlling the voltage for driving the transfer sheet transporting motor 16.

Maintaining the state wherein the detectors 20*a* and 20*b* are positioned within the detecting range of the sensors 21*a* and 21*b* maintains both the rotational angle of the tension roller supporting frames 18*aa* and 18*ab* rotating on the rotating center Ra and the rotational angle of the tension roller supporting frames 18*ba* and 18*bb* rotating on the rotating center Rb at a constant angle. Consequently, the rotational angle centered on the rotating center Ra of the tension roller 17*a* rotatably supported by the tension roller supporting frames 18*aa* and 18*ab*, and the rotational angle centered on the rotating center Rb of the tension roller 17*b* rotatably supported by the tension roller supporting frames 18*ba* and 18*bb*, are fixed at a predetermined angle. At this time, the rotational angles of the tension rollers 17*a* and 17*b* rotating on the rotating centers Ra and Rb, and the tension force of the intermediate transfer sheet 7 are in a constant relation, so the setting the rotation angles of the tension rollers 17*a* and 17*b* rotating on the rotating centers Ra and Rb at a predetermined angle, i.e., wherein the detectors 20*a* and 20*b* are within a set detecting range of the sensors 21*a* and 21*b*, allows the tension of the intermediate transfer sheet 7 to be maintained constant.

Note that the tension of the intermediate transfer sheet 7 can also be maintained constant by using pinch rollers instead of the tension rollers 17*a* and 17*b*, but the structure becomes more complex in this case. Accordingly, the terminal transfer line printer 1 according to the present embodiment allows the tension of the intermediate transfer sheet 7 to be maintained constant. Also, with the thermal transfer line printer according to the present embodiment, the tension rollers 17*a* and 17*b* are provided on either side of the primary image forming unit 24, so the tension of the intermediate transfer sheet 7 can be maintained constant, regardless of the transporting direction of the intermediate transfer sheet 7.

Figure 13:
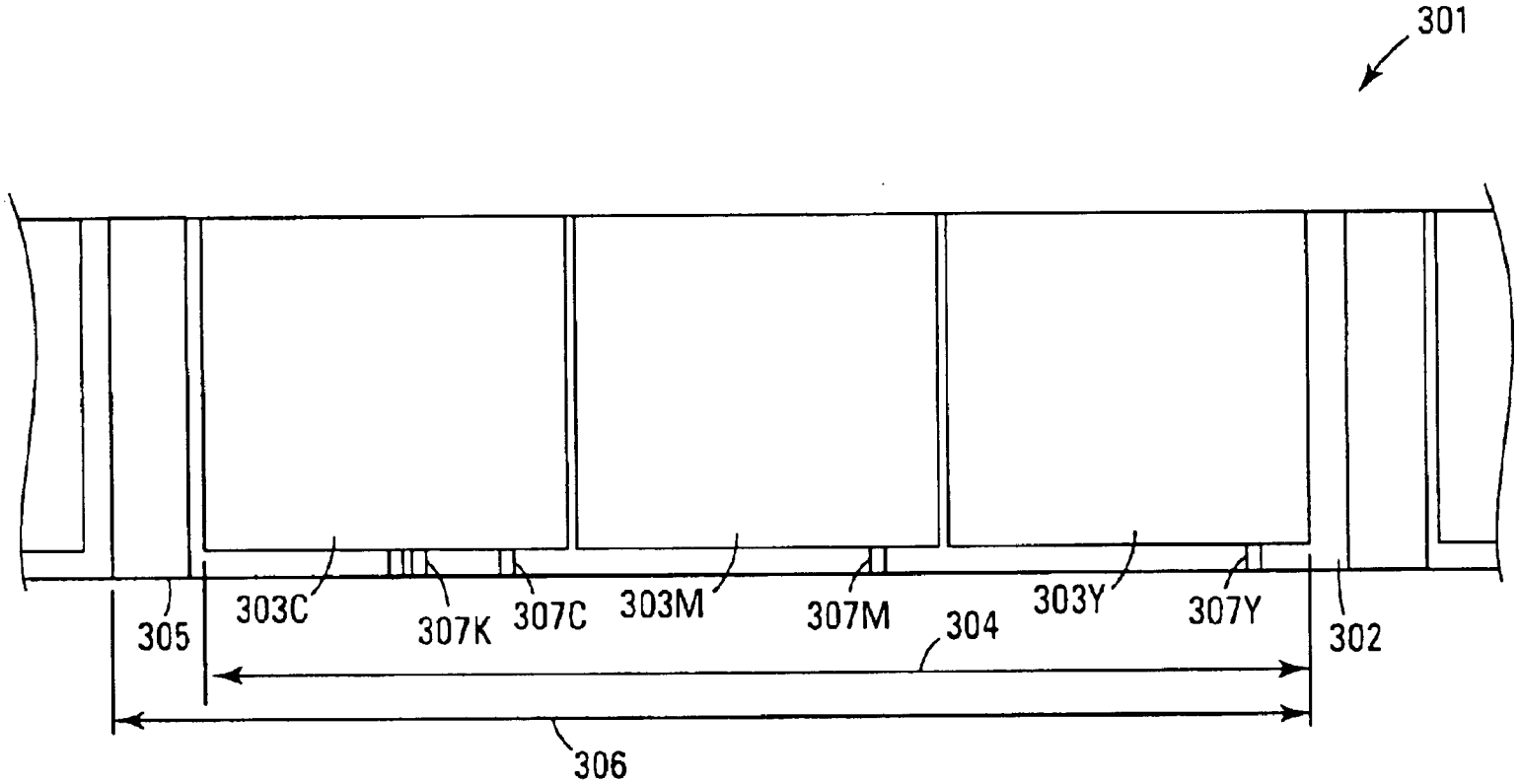
FIG. 13 is a diagram showing the construction of a multicolor ink film used in an embodiment of the present invention.

As shown in FIG. 13, a multicolor ink film 301 used in this embodiment comprises a film base material 302 formed of an elongate film of resin such as PET. A unit recording cycle 304 is arranged repeatedly on one surface of the film base material 302 in the longitudinal direction. The unit recording cycle 304 comprises ink areas 303 of three C, M and Y colors (C-color ink area 303C, M-color ink area 303M, and Y-color ink area 303Y), which are arranged successively for forming a full color image. A fourth color, W, can be provided to print a background color for the image. The W region is not illustrated in FIG. 13. In an intermediate transfer process of forming a full-color primary transfer image as a reversed image on an intermediate transfer medium (sheet), the C-color ink area 303C, the M-color ink area 303M, and the Y-color ink area 303Y of the unit recording cycle 304 are used in this order. The multicolor ink film 301 of this embodiment includes, in a boundary portion between the unit recording cycles 304 adjacent to each other, a marker-transfer ink area 305 of K color as an ink area dedicated for transferring, onto the intermediate transfer medium, a positioning mark which serves as a position reference in the intermediate transfer process of forming a primary transfer image on the intermediate transfer medium and in a process of retransferring the primary transfer image onto a medium on which the image is to be transferred. An image-forming recording cycle 306 is constituted by one marker-transfer ink area 305 and one unit recording cycle 304 arranged immediately after the marker-transfer ink area 305.

Further, on the multicolor ink film 301 of this embodiment, the three-color ink areas 303 constituting the unit recording cycle 304 is formed such that a narrow gap portion is left to make the film base material 302 exposed therein along one side of the film base material 302 in each region where the image-forming recording cycle 306 is formed. Detection markers 307 are formed in the gap portion for detecting the foremost positions of the marker-transfer ink area 305 of the image-forming recording cycle 306 and the three-color ink areas 303 of the unit recording cycle 304. Each of the detection markers 307 comprises one or more markers in the form of thick ink lines extending in the gap portion in the width direction of the film base material 302. Each detection marker 307 is formed so as to have its rearward end positioned away from the foremost position of corresponding one of the marker-transfer ink area 305 and the three-color ink areas 303 of the unit recording cycle 304 by a predetermined distance upstream in the direction of transport of the multicolor ink film 301.

When a marker detecting sensor provided in the line thermal printer detects the detection marker 307, the foremost position of each ink area 303, 305 indicated by the detection marker 307 is supplied from a control section to a recording section of the line thermal printer. It is thereby confirmed that the printer is in a state capable of transferring the ink of the ink area 303 onto the intermediate transfer medium.

A method of forming a primary transfer image in this embodiment is carried out by employing the multicolor ink film 301 in which an ink area capable of transferring a positioning mark onto an intermediate transfer medium, such as the marker-transfer ink area 305 described above, is formed immediately before the image-forming recording cycle 306. The construction of the multicolor ink film 301 itself is not limited to the above-described one. The intermediate transfer medium can include a base material and a protective layer upon which the ink is applied. The ink and protective coating are then retransferred to the CD such that the protective coating is the top layer of the image. The protective coating provides UV and/or scratch protection for the underlying image. Any known thermally transferable clear material which provides the desired level of protection can be used, and the present invention is not limited to a specific composition.

Figure 14:
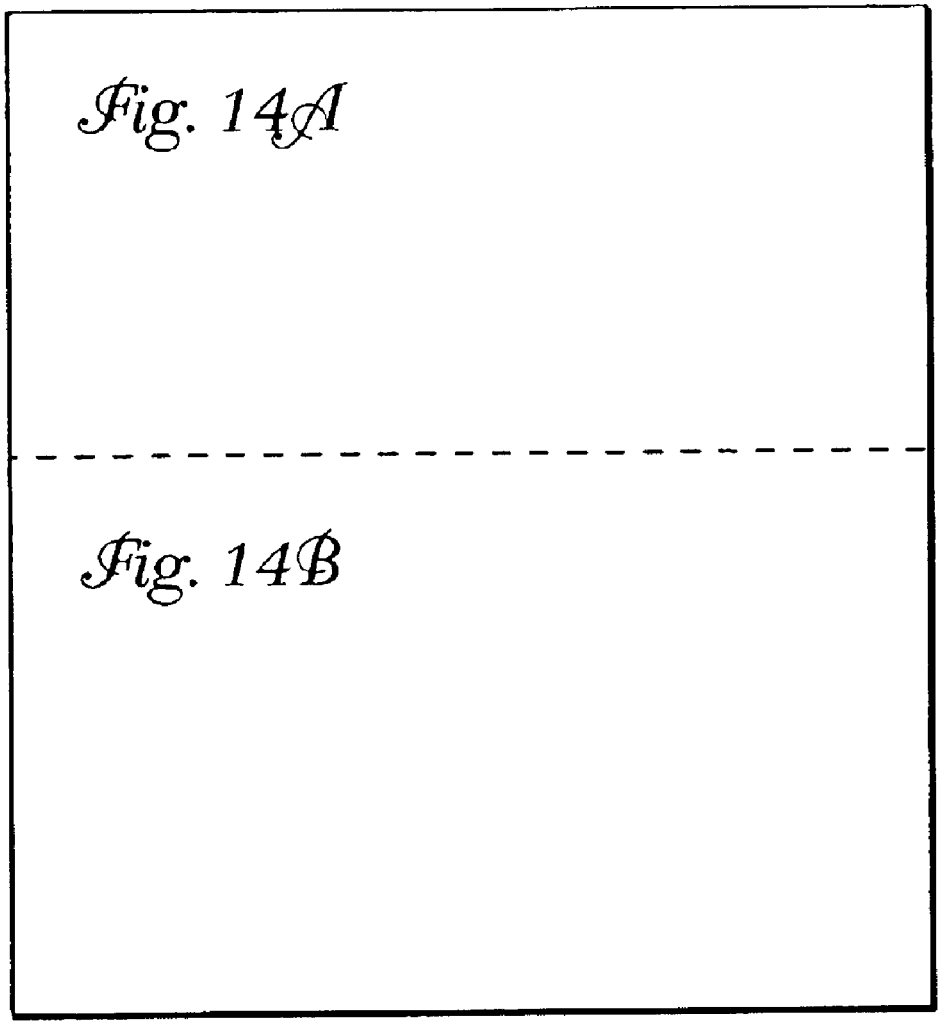
FIG. 14 is a flowchart showing a control sequence executed by a control section of a line thermal printer of the embodiment.
Figure 14A:
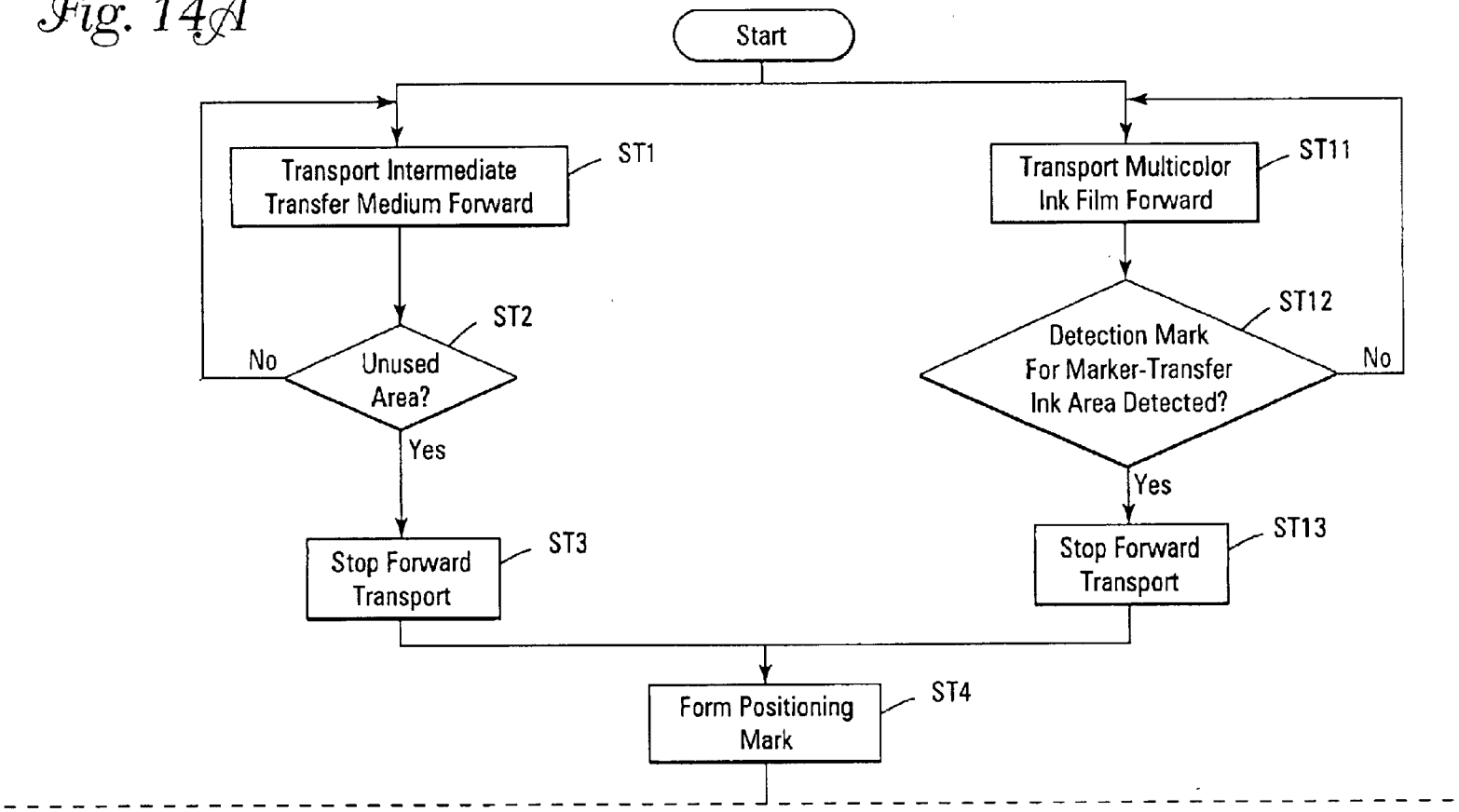
Figure 14B:
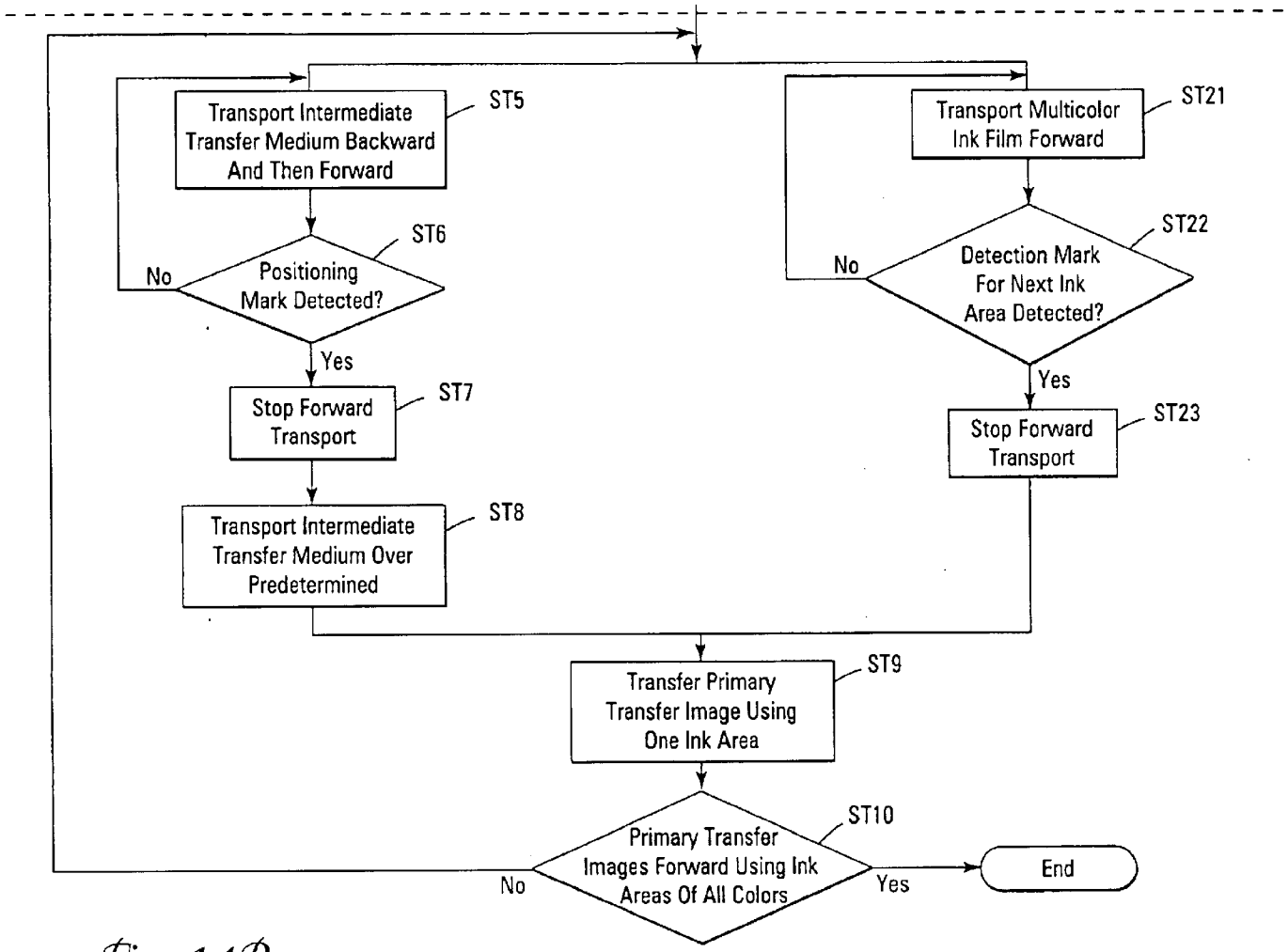

FIG. 14 is a flowchart showing a control sequence executed by the control section of the line thermal printer of this embodiment. The control sequence include, in the method of forming a primary transfer image, transport control of the intermediate transfer medium, transport control of the multicolor ink film 301 in relation to transfer of the positioning mark, and transport control of the multicolor ink film 301 for forming a full-color primary transfer image using the three-color ink areas 303 of the unit recording cycle.

As shown in the flowchart, when the image forming operation of the line thermal printer is started, an intermediate transfer medium transport motor is driven in accordance with an instruction from the control section to idly transport the intermediate transfer medium (step ST1). An unused area of the intermediate transfer medium is detected by a not-shown sensor (step ST2), and the intermediate transfer medium is positioned such that the head of the unused area is aligned with the position of a heat generating device of a line thermal head (referred to also as "recording section") (step ST3).

In parallel, a film transfer motor is driven to transport the multicolor ink film 1 in the forward direction (step ST11). When the marker detecting sensor (not shown) provided in the line thermal printer detects the detection marker 307K indicating the foremost position of the marker-transfer ink area 305 (step ST12), the transport of the multicolor ink film 301 is stopped (step ST13). In this condition, the line thermal head is moved down and a positioning mark is formed on the intermediate transfer medium by using the marker-transfer ink area 305 (step ST4).

Thereafter, the intermediate transfer medium having the positioning mark formed thereon is transported backward to such an extent that the position, at which the positioning mark has been formed, is located upstream of the mount position of the marker detecting sensor in the transport direction, and is then transported forward again (step ST5). Proper alignment of the positioning mark formed on the intermediate transfer medium is thereby made (steps ST6 and ST7). Subsequently, the intermediate transfer medium is further idly transported forward over a predetermined distance with the aligned positioning mark as a reference (step ST8). In parallel, the transport control of the multicolor ink film 1 is performed. Specifically, a film transport motor is driven to transport the multicolor ink film 301 (step ST21), and the detection marker 307C indicating the foremost position of the C-color ink area 303C, i.e., the first ink area of the unit recording cycle 304, is detected (step ST22). The detected foremost position of the C-color ink area 303C is supplied to the recording section (step ST23), and a C-color reversed image of one image unit is formed on the intermediate transfer medium by using the C-color ink area 303C of the multicolor ink film 301 (step ST9).

It is then determined whether primary transfer images have been formed using all of the three-color ink areas of the unit recording cycle 304 (step ST10). If those primary transfer images have been formed, the process of forming the primary transfer images is ended at once. If not, the control process returns to the above steps ST5 and ST21.

More specifically, the intermediate transfer medium, which has been transported forward during the process of forming the C-color primary transfer image, is transported backward for proper alignment of the positioning mark formed on the intermediate transfer medium. In parallel, as with the control sequence described above, the detection marker 307M indicating the foremost position of the M-color ink area 303M, i.e., the second ink area of the unit recording cycle 4 formed on the multicolor ink film 301, is detected. The detected foremost position of the M-color ink area 303M is supplied to the recording section, and an M-color reversed image of one image unit is formed in a superimposed relation to the C-color reversed image of one image unit, which has been formed on the intermediate transfer medium, by using the M-color ink area 303M of the multicolor ink film 301. In the above description, the step of idly transporting the intermediate transfer medium over the predetermined distance after the detection of the positioning mark is a matter of design choice. By idly transporting the intermediate transfer medium over the predetermined distance with the positioning mark as a reference, as described above, the positioning mark is prevented from being located close to a head portion of the primary transfer image. When the primary transfer image is retransferred later onto the medium on which the image is to be transferred, it is hence possible to prevent a drawback that the positioning mark is also retransferred onto the transferred medium due to a position shift or the like.

Next, in a similar manner, the intermediate transfer medium, which has been transported forward during the process of forming the M-color primary transfer image, is transported backward over a certain distance and then transported forward again for proper alignment of the positioning mark formed on the intermediate transfer medium. Subsequently, for the reason described above, the intermediate transfer medium is further idly transported forward over the predetermined distance with the aligned positioning mark as a reference. In parallel, the detection marker 307Y indicating the foremost position of the Y-color ink area 303Y, i.e., the third ink area of the unit recording cycle 304 formed on the multicolor ink film 301, is detected. The detected foremost position of the Y-color ink area 303Y is supplied to the recording section, and a Y-color reversed image of one image unit is formed in a superimposed relation to the C-color reversed image and the M-color reversed image each being of one image unit, which have been formed on the intermediate transfer medium, by using the Y-color ink area 303Y of the multicolor ink film 301.

In this way, a desired reversed image is formed as a full-color primary transfer image of one image unit on the intermediate transfer medium. After the formation of the primary transfer image, the intermediate transfer medium is transported to such an extent that the primary transfer image formed on the intermediate transfer medium is moved to a location just short of the retransfer position. Then, the primary transfer image and the transferred medium formed on the intermediate transfer medium are properly positioned using the positioning mark formed on the intermediate transfer medium. In a retransfer section, the primary transfer image formed on the intermediate transfer medium is retransferred onto the transferred medium by utilizing heat and pressure applied from a retransferring mechanism formed of a heating roller, for example, whereby a desired image is recorded.

With the method of forming the primary transfer image and the intermediate transfer printer according to this embodiment, as described above, a positioning mark is first formed in an unused area of the intermediate transfer medium. After that, a primary transfer image of each color is transferred onto the intermediate transfer medium by using an ink area of each color with the positioning mark as a reference. Therefore, the primary transfer images of three colors can be superimposed one above the other with high accuracy.

Further, by first forming positioning mark on the intermediate transfer medium, the intermediate transfer medium can be used in units of appropriate length in match with the image area to be formed. It is hence possible to avoid wasteful use of the intermediate transfer medium as having been experienced conventionally. It should be noted that the multicolor ink film used in the present invention is not limited to the embodiment described above, but may be modified as required.

CONCLUSION

A compact disc transporter has been described that includes a two-step retransfer printer. The printer uses an intermediate transfer sheet to receive a print image that is subsequently transferred to a compact disc. The transporter allows parallel processing of image data and content data. A significant time reduction can be achieved by pre-printing the image to a transfer sheet prior to transferring the image to a CD. The thermal transfer line printer maintains constant tension of the intermediate transfer sheet. Further, an index mark is printed on the transfer sheet to increase the accuracy in positioning a primary transfer image of each color ink and hence improve printing quality.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A compact disc processing system comprising a data recorder to record content to a compact disc;

a transporter to transport the compact disc; and a re-transfer printer to print an image to an internal intermediate transfer sheet and transfer the image from the transfer sheet to the compact disc;

wherein the printer comprises:

tension rollers positioned so as to face a transporting path of the intermediate transfer sheet;

tension roller supporting frames rotatably supporting the tension rollers and pressing the tension rollers toward the intermediate transfer sheet;

tension roller position sensor to detect a position of the tension rollers; and a control unit to control the actions of at least an intermediate transfer sheet transporting motor for transporting the intermediate transfer sheet.

2. A compact disc processing system comprising:

a data recorder to record content to a compact disc;

a transporter to transport the compact disc; and a re-transfer printer to print an image to an internal intermediate transfer sheet and transfer the image from the transfer sheet to the compact disc;

wherein the printer comprises:

a line thermal head for transferring inks from a multicolor ink sheet to the intermediate transfer sheet; and a re-transfer mechanism including a heating roller, a heating roller actuator mechanism to actuate the heating roller towards and away from the intermediate transfer sheet;

wherein the printer further comprises a re-transfer mark detector to detect an alignment mark formed on the intermediate transfer sheet;

wherein the printer further comprises a controller to control the heating roller actuator mechanism, such that the heating roller actuator mechanism can be selectively set at least to one of a weak contact state in which the heating roller contacts with the intermediate transfer sheet with a small contact pressure and a strong contact state in which the heating roller contacts with the intermediate transfer sheet with a large contact pressure; and wherein the controller controls the timing of operation of the heating roller a actuator mechanism in such a manner that the heating roller is set to the weak contact state at a moment prior to the detection of the alignment mark by the re-transfer mark detector and is set to the strong contact state at a timing determined by using as the time reference the moment at which the re-transfer mark is detected.

3. A content on demand processing system comprising:

a processor;

a data recorder to record content to a compact disc, wherein the content is provided by the processor;

a transporter to transport the compact disc; and a re-transfer printer to print an image to an internal intermediate transfer sheet and transfer the image from the transfer sheet to the compact disc, wherein image data is provided by the processor;

wherein the printer comprises:

tension rollers positioned so as to face a transporting path of the intermediate transfer sheet;

tension roller supporting frames rotatably supporting the tension rollers and pressing the tension rollers toward the intermediate transfer sheet;

tension roller position sensor to detect a position of the tension rollers; and a control unit to control the actions of at least an intermediate transfer sheet transporting motor for transporting the intermediate transfer sheet.

4. A content on demand processing system comprising:

a processor;

a data recorder to record content to a compact disc, wherein the content is provided by the processor;

a transporter to transport the compact disc; and a re-transfer printer to print an image to an internal intermediate transfer sheet and transfer the image from the transfer sheet to the compact disc, wherein image data is provided by the processor;

wherein the printer comprises:

a line thermal head for transferring inks from a multicolor ink sheet to the intermediate transfer sheet; and a re-transfer mechanism including a heating roller, a heating roller actuator mechanism to actuate the heating roller towards and away from the intermediate transfer sheet;

wherein the printer further comprises a re-transfer mark detector to detect an alignment mark formed on the intermediate transfer sheet;

wherein the printer further comprises a controller to control the heating roller actuator mechanism, such that the heating roller actuator mechanism can be selectively set at least to one of a weak contact state in which the heating roller contacts with the intermediate transfer sheet with a small contact pressure and a strong contact state in which the heating roller contacts with the intermediate transfer sheet with a large contact pressure; and wherein the controller controls the timing of operation of the heating roller a actuator mechanism in such a manner that the heating roller is set to the weak contact state at a moment prior to the detection of the alignment mark by the re-transfer mark detector and is set to the strong contact state at a timing determined by using as the time reference the moment at which the re-transfer mark is detected.

5. A method of operating a compact disc (CD) transporter comprising:

inserting the CD into a printer;

printing a positioning mark on an intermediate transfer sheet, wherein the intermediate transfer sheet serves as a position reference;

forming a primary transfer image of plural colors on the intermediate transfer sheet in a superimposed relation with the transferred positioning mark as a reference;

retransferring the primary transfer image onto the inserted CD;

transporting the intermediate transfer sheet backward after forming the positioning mark, and transporting the intermediate transfer sheet forward in alignment with the positioning mark; and forming a primary transfer image in multiple colors using colors formed on a multicolor ink film with the positioning mark as a reference.

6. The method of claim 5 further comprising idly transporting the intermediate transfer sheet over a predetermined distance with the positioning mark as a reference, after proper alignment of the positioning mark.

* * * * *